United States Patent [19]

Shio et al.

[11] Patent Number: 4,905,753

[45] Date of Patent: Mar. 6, 1990

[54] TWIN BELT TYPE CASTING MACHINE

[75] Inventors: Kiyomi Shio, Kitakyushu; Kaname Wada, Kimitsu; Katsuhiro Maeda, Oita; Noriyuki Kanai, Oita; Hideyuki Takahama, Oita; Keiichi Katahira; Tsuyoshi Saeki, both of Kitakyushu, all of Japan

[73] Assignee: Nippon Steel Corporation, Tokyo, Japan

[21] Appl. No.: 203,980

[22] Filed: Jun. 8, 1988

[30] Foreign Application Priority Data

| | | | |
|---|---|---|---|
| Jun. 8, 1987 | [JP] | Japan | 62-143684 |
| Jul. 27, 1987 | [JP] | Japan | 62-188512 |
| Dec. 8, 1987 | [JP] | Japan | 62-310595 |
| Dec. 8, 1987 | [JP] | Japan | 62-310596 |

[51] Int. Cl.[4] ..... B22D 11/06; B22D 11/124

[52] U.S. Cl. ..... 164/431; 164/432; 164/443

[58] Field of Search ..... 164/431, 432, 430, 443

[56] References Cited

U.S. PATENT DOCUMENTS

| | | | |
|---|---|---|---|
| 3,878,883 | 4/1975 | Hazelett et al. . | |
| 3,937,270 | 2/1976 | Hazelett et al. . | |
| 4,759,400 | 7/1988 | Bessho et al. | 164/431 X |

FOREIGN PATENT DOCUMENTS

| | | | |
|---|---|---|---|
| 59-58550 | 4/1984 | Japan . | |
| 60-158959 | 8/1985 | Japan | 164/432 |
| 60-166145 | 8/1985 | Japan | 164/432 |
| 61-99541 | 5/1986 | Japan . | |
| 62-6743 | 1/1987 | Japan | 164/432 |
| 62-275549 | 11/1987 | Japan | 164/430 |

OTHER PUBLICATIONS

Iron and Steel Engineer, vol. 64, No. 2, Feb. 1987, Pittsburgh, PA, U.S., P. C. Regal et al.: "Hazelett Twin--Belt Caster for Thin Slabs" pp. 41–46.

*Primary Examiner*—Nicholas P. Godici
*Assistant Examiner*—J. Reed Batten, Jr.
*Attorney, Agent, or Firm*—Pollock, Vande Sande & Priddy

[57] ABSTRACT

A twin belt continuous casting machine for producing thin slabs includes a pair of belts and a pair of edge dams for forming a metal pool, which are movable in the transverse direction of the belt. A plurality of cooling-/heating chambers partitioned in the transverse direction of the belt are provided on the rear surface of the belt in the vicinity of respective side end portions of the belts. A plurality of supporting members which are capable of pressing the rear surface of the belt are respectively provided in the plurality of cooling/heating chambers. The movement of the edge dams is synchronized with the operation of the plurality of supporting members. A fluid introduced into each of the cooling-/heating chambers is changed into a heating fluid or a cooling fluid in synchronism with the movement of the edge dams.

8 Claims, 23 Drawing Sheets

TWIN BELT TYPE CASTING MACHINE

BACKGROUND OF THE INVENTION

The present invention relates to a twin belt type casting machine which is capable of freely altering the width of a thin slab produced, and more particularly to a twin belt type casting machine which is capable of preventing the deformation of belts and a method of casting by using the same.

In recent years, a continuous casting method for directly producing from molten metal, such as molten steel, a thin slab having a thickness of several millimeters to several dozens of millimeters and a configuration close to that of a final product has come to be highlighted. According to this method, since it is possible to omit a rolling process involving a multiplicity of stages which have conventionally been used, the processes and facilities can be simplified. In addition, since steps for heating the basic material to a working temperature between the respective processes are essentially unrequired, it is possible to expect an energy-saving effect. Among such continuous casting methods, a twin belt type casting method is known.

In this twin belt type casting machine, the molten metal in a tundish is supplied through a nozzle into a casting space. This casting space is defined by a space formed between a pair of belts which are made of a heat-resisting material such as steel and are respectively adapted to run by being trained among pulleys, the both side portions of the space being respectively partitioned by edge dams. The molten metal poured into this casting space is cooled and solidified by cooling boxes and is discharged as a thin slab.

At this time, if there is any clearance between the belt and the edge dam, the molten metal would enter that clearance, resulting in an outset. For this reason, it is necessary to press the belt against the edge dam.

As for the edge dam, there are the following two types; one is a type which does not move in the direction of movement of the metal being cast, and the other is an endless coupled type edge dam which moves in synchronism with the movement of the metal being cast. Although these two types are generally called an edge dam, when the two types are expressed individually, the former is called a fixed edge dam, and the latter a synchronously moving edge dam.

When the width of the metal being cast is altered by using the fixed edge dams, the edge dams are expanded or shrunk in the transverse direction of the belt, i.e., perpendicularly to the direction of movement of the belt.

Meanwhile, when the width of the metal being cast is altered by using the synchronously moving edge dams, there are the following two methods; one in which the synchronously moving edge dams are expanded or shrunk together with bases thereof in the transverse direction of the belt, and the other in which, when cooling blocks constituting the synchronously moving edge dams are inserted consecutively between the belts in the moving direction thereof, the blocks are inserted after the positions of installation of the blocks are changed to the expanded or shrunk positions in the transverse direction of the belt. In this case, although the blocks themselves do not move in the transverse direction of the belt, the width of the cast piece is varied by the insertion of the group of blocks whose positions have been changed.

Thus, although there are various methods of varying the width of the metal being cast, in the present invention, the movement described in these methods will, for simplicity's sake, be generally referred to as the transverse (widthwise) movement of the edge dams.

The present inventors have developed a mechanism for pressing the edge dams, and filed an application for patent as Japanese Patent Laid-Open Publication No. 61-99541. In this apparatus, the edge dams are disposed such as to be movable in the transverse direction of the belt, and edge dam supporting blocks are also provided in the cooling box in addition to edge dams disposed on both sides of the cooling box. These edge dam supporting blocks are capable of pressing and depressing freely the belts as a driving force of a pressing device is transmitted thereto through a rod. Thus the width of the thin slab can be altered as a plurality of such edge dam supporting blocks are provided in the transverse direction of the cooling box.

Namely, when a thin slab of a maximum width is produced, the both side portions of the casting space are partitioned by the outside edge dam supporting blocks. At this time, a refrigerant is supplied to the entire space between the belt and the cooling box. When a thin slab of a small width is produced, the edge dams are moved to inward locations in the transverse direction of the belt, and the edge dam supporting blocks in those locations are pressed against the belt to form the casting space. In addition, the refrigerant is supplied to a gap between the portion of the belt which is disposed inwardly of the edge dam supporting block in relation to the transverse direction of the belt and the cooling box, while the supply of the refrigerant to a gap located outwardly thereof is stopped. A plurality of ribs are provided on the surface of the cooling box opposed to the belt, and these ribs serve to prevent the belt from approaching excessively to the cooling box by the static pressure of the molten metal and to secure a predetermined channel for the refrigerant.

As the edge dam supporting blocks are thus made movable, it becomes possible to produce a thin slab having a required width by means of the same continuous casting apparatus.

In addition, when the thin slab is being cast, the portion of the overall surface of the belt which is brought into contact with the molten metal is subjected to a large heat flux, the temperature of the belt itself becomes higher in a central portion thereof as compared with the other portions. As a result, the belt undergoes thermal expansion at the central portion thereof, and it is known that this causes the deformation of the belts. This condition is schematically shown in FIG. 26. As a method of preventing this deformation, it is effective to make the temperature of the overall surface of the belts uniform. For instance, in U. S. patent application No. 3,937,270 (Japanese Patent Examined Publication No. 57-61502), it is assumed that the cause of the occurrence of displacement of the belts lies in the cold framing on the entrance side of casting, and as a measure against it a proposal is made therein to make the temperature of the belts higher in advance. In addition, in Japanese Utility Model Unexamined Publication No. 59-58550, a proposal is made to heat the opposite side end portions of the belts so as to set the temperature of those portions at the same level as that of the central portion thereof.

Furthermore, it is proposed in U.S. patent application No. 3937270 (Japanese Patent Examined Publication No. 57-61502) that, when producing cast slabs with different widths by using one type of belt mold, the quantity of water at opposite side end portions of the belts be changed. However, no means has yet been proposed which allows the positions of cooled portions and uncooled portions to be changed by following the change in the width of the thin slab being cast, when the width of the thin slab is changed while the casting thereof is being continued.

This problem becomes important particularly during a casting process, i.e., when the casting width is changed without interrupting the casting process. Namely, when the width of the metal being cast has been changed, it is also necessary to change simultaneously the range of cooling water located on the rear surface of the belts in the transverse direction thereof. To take a more positive measure, it is necessary to simultaneously change heating ranges at opposite side end portions of the belts, but this means has not yet been proposed.

Furthermore, it has been found that it is difficult to restrain the deformation of the belts by adjusting the temperature distribution of the belts in the transverse direction thereof and by heating the opposite side end portions thereof to such a extent that no adverse effect is exerted to the thin slab. The reason for this difficulty is that, in the temperature distribution of the belt, there are two temperature distributions in the width-wise direction and the thickness-wise direction of the belt, and although, with the proposed method described above, the temperature distribution in the transverse direction of the belt can be made uniform, the temperature distribution in the thickness-wise direction of the belt cannot be made uniform. In other words, according to the proposed method described above, it is possible to prevent the deformation in the transverse direction of the belt, but the deformation in the longitudinal direction of the belt cannot be prevented.

As a measure against this problem, U.S. patent application No. 3,878,883 (Japanese Patent Examined Publication No. 59-4225) discloses stretching the belts and imparting thereto tension of 8,000 to 20,000 pounds per square inch of the cross section of the belt.

However, it has been found that, with this method as well, it is impossible to sufficiently prevent the occurrence of displacement of the belts when casting is effected while changing the width of metal being cast.

SUMMARY OF THE INVENTION

Accordingly, it is a primary object of the present invention to provide a twin belt type casting machine which facilitates a change in the width of a thin slab by automatically effecting the advance and retreat of edge dam supporting blocks and the movement of partitions between a cooling medium and a heating medium in synchronism with the movement of the edge dams, thereby overcoming the above-described drawbacks of the prior art.

Another object of the present invention is to provide a twin belt type casting machine which is capable of reducing the deformation of belts during a casting process to such a degree that is substantially harmless, thereby making it possible to produce high-quality thin slabs.

To these ends, according to one aspect of the present invention, there is provided a twin belt type continuous casting machine having a pair of belts and a pair of edge dams disposed between the pair of belts to define a metal pool so as to produce a thin slab by allowing a molten metal poured into the metal pool to be cooled and solidified, the edge dams being disposed between the belts in such a manner as to be movable in the transverse direction of the belts. The twin belt type continuous casting machine according to the present invention comprises a plurality of cooling/heating chambers disposed respectively such as to be adjacent to respective rear surfaces of the pair of belts and to be in the vicinity of side end surfaces of the belts in a transverse direction of the belts and partitioned in the transverse direction; a cooling box disposed in the vicinity of a central portion in the transverse direction of the belts; a plurality of pressing means which are capable of pressing the rear surfaces of the belts; a fluid supplying piston header in which one portion of an internal space thereof divided into two by a piston is connected to a cooling water supplying source, and the other portion thereof is connected to a heating medium supplying source for heating side end surfaces of the belts, a plurality of branch channels respectively communicating with the plurality of cooling/heating chambers in the axial direction being provided in the internal space; a discharge piston header provided with a plurality of discharge-side branch channels respectively communicating with the plurality of cooling/heating chambers; and a control device for selectively actuating at least one of the plurality of pressing means in such a manner as to press the belts against the edge dams moved.

According to another aspect of the invention, there is provided a method of twin belt type continuous casting for producing a thin slab by allowing a molten metal poured into a metal pool to be cooled and solidified by using a continuous casting machine having a pair of belts and a pair of edge dams for defining the metal pool between the pair of belts, comprising the steps of: applying tension of 10 kgf/mm$^2$ or more to the belts; and heating side end portions of the belts to from 100° C. to 250° C.

In the twin belt type casting machine in accordance with the present invention, since the piston is moved in correspondence with the movement of the edge dams in the transverse direction of the belt, the edge dams are pressed at positions corresponding to a targeted slab width, and an operation of separating portions of the belt to be heated from portions thereof to be cooled is performed automatically. Thus it is possible to readily produce high-quality thin slabs having various widths while the deformation of the belts is being prevented. In addition, in the method of twin belt type continuous casting in accordance with the present invention, since the temperature distribution of the belts in the transverse direction thereof can be made uniform, the deformation of the thin slab in the transverse direction of the belt can be prevented. Furthermore, as tension is applied to the belts, the deformation of the thin slab in the longitudinal direction of the belt can be restrained.

The above and other objects, features and advantages of the present invention will become more apparent from the following description of the invention when read in conjunction with the accompanying drawings.

BRIEF DESCRIPTION OF THE DRAWINGS

FIGS. 14*a*, 14*b*, and 14*c* are enlarged views of one of belt supporting disks, in which FIG. 14*b* is a cross-sectional view taken along the line XIV*b*—XIV*b* of FIG. 12;

FIG. 14*c* is a cross-sectional view taken along the line XIV*c*—XIV*c* of FIG. 12;

DESCRIPTION OF THE PREFERRED EMBODIMENTS

Referring now to the accompanying drawings, the features of the present invention will be described specifically on the basis of embodiments of the present invention.

Figure 25:
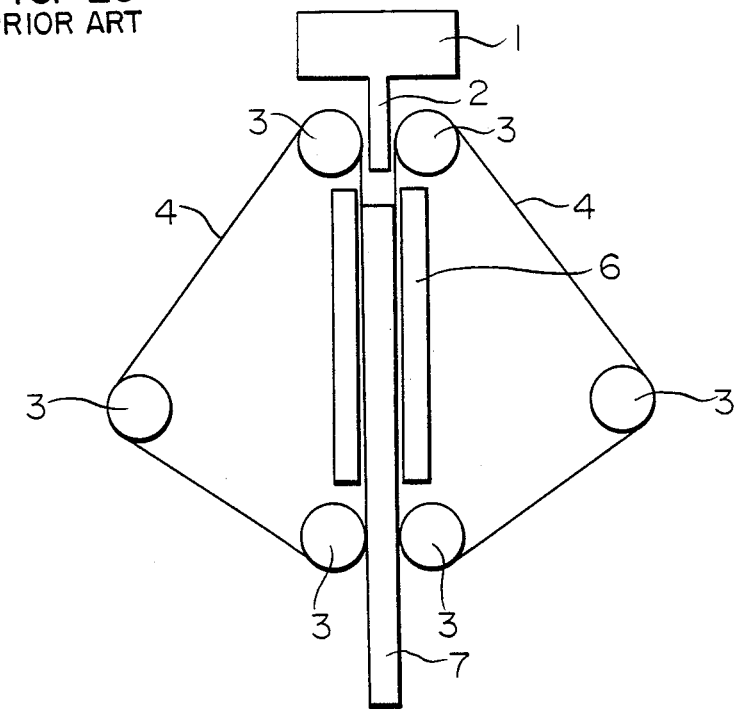
FIG. 25 PRIOR ART
FIG. 25 is a diagram schematically illustrating a conventional twin belt type continuous casting machine.
Figure 26:
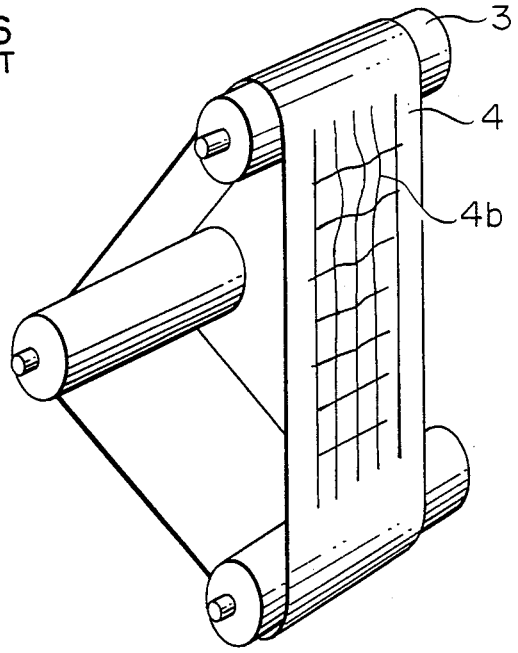
FIG. 26 PRIOR ART
FIG. 26 is a schematic diagram illustrating the deformation of the belt occurring during casting in a case where measures adopted in the present invention are not provided.

FIG. 25 is a diagram of a conventional twin belt type continuous casting machine. The molten metal poured into a tundish 1 passes through a nozzle 2, and is poured into a casting space formed by a pair of belts 4, each trained among pulleys 3, and a pair of edge dams 5 (not shown). A cooling box 6 is provided on the rear surface of the belt 4, and serves to cool the belt by means of, for instance, cooling water so as to allow the molten metal to solidify. The metal which has completely solidified or whose shell alone has solidified is continuously drawn out from a lower portion of the casting machine in the form of a thin slab 7.

Figure 1:
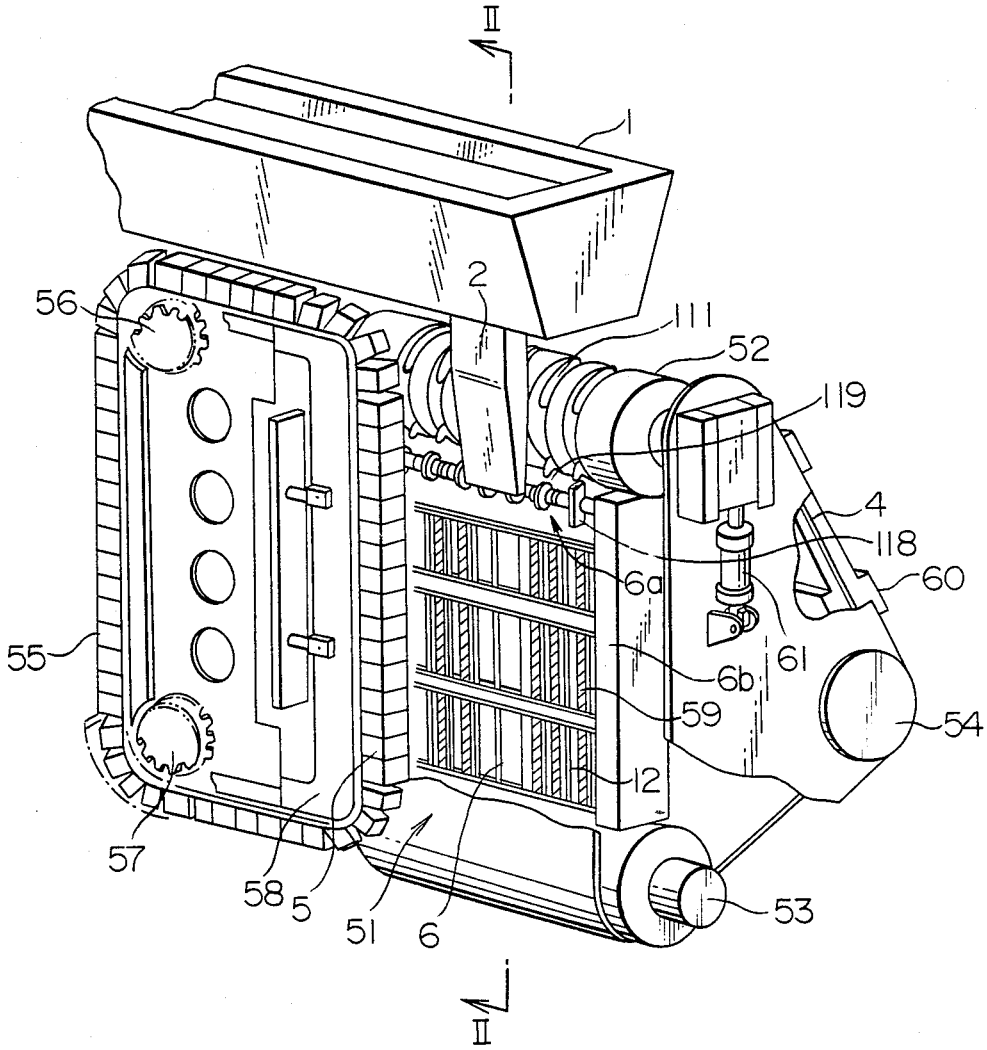
FIG. 1 is a partly cutaway perspective view illustrating an overall arrangement of a twin belt type continuous casting machine in accordance with the present invention.
Figure 2:
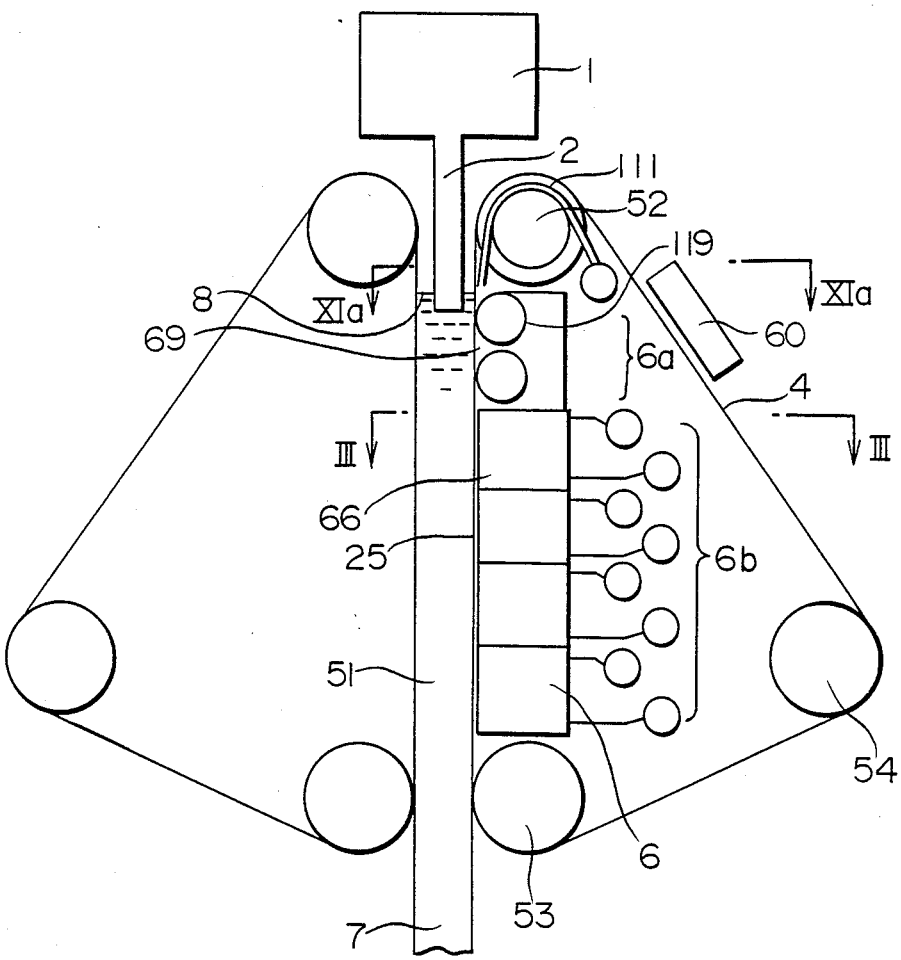
FIG. 2 is a cross-sectional view taken along the line II—II of FIG. 1, illustrating the arrangement of internal cooling and belt-supporting devices surrounded by three pulleys and a belt.

FIG. 1 is a partly cutaway perspective view illustrating an overall arrangement of the twin belt type continuous casting machine embodying the present invention, by incorporating the apparatus shown in FIG. 25. In the drawing, a belt unit on one side of the twin belt type continuous casting machine and a synchronously moving edge dam 5 are illustrated. FIG. 2 is a cross-sectional view taken along the line II—II of FIG. 1, illustrating a cooling device disposed on the rear surface of the belt. In these two drawings, the cooling box 6 is constituted by a jet cooling portion 6*a* in an upper stage and a pad cooling portion 6*b* is a lower stage. Since the molten metal has a small static pressure, it is impossible to press the belt from the rear surface thereof by pressurizing the same, and to obtain a high.heat dissipating effect, the jet cooling portion 6*a* is arranged such that the rear surface of the belt is cooled by a jet current jetted out from a jet nozzle 111.

In addition, to maintain the flat surface of the belt, the belt is supported from the rear surface thereof by means of a fine roll 119.

A pad structure is adopted for the pad cooling portion 6*b* so as to dissipate heat while opposing the static pressure of the molten metal, and pressurized cooling water is arranged to flow through water channels 25. The belt is slidably supported by cooling pad fins 12 so as to keep the thickness of the water channels 25 constant. However, since the majority of the static pressure of the molten metal is supported by the static pressure of the cooling water inside the pad, no large force is applied to the cooling pad fins 12.

The belt 4 is trained among an upstream-side pulley 52, a downstream-side pulley 53, and a steering pulley 54, and a fixed tension is applied thereto by means of a tensioning cylinder 61, and rotates as a driving force is imparted thereto by one of the pulleys.

Meanwhile, the edge dam 5 which is arranged with a train of a multiplicity of edge dam blocks 55 so as to rotate in synchronism with the belt, travels along a guide 58, and is driven by an upstream-side sprocket 56 or a downstream-side sprocket 57.

As for this edge dam, the width of a mold 51 can be varied if the guide 58 is moved in the transverse direction. If there is any clearance between the edge dam 5 and the belt 4, the molten metal enters the same and forms a flash. To eliminate this clearance, therefore, the jet cooling portion 6*a* is provided with a belt pressing block 118 for pressing the edge dam portion of the belt, while the pad cooling portion 6*b* is provided with a mechanism 59 for pressing the belt.

Figure 3:
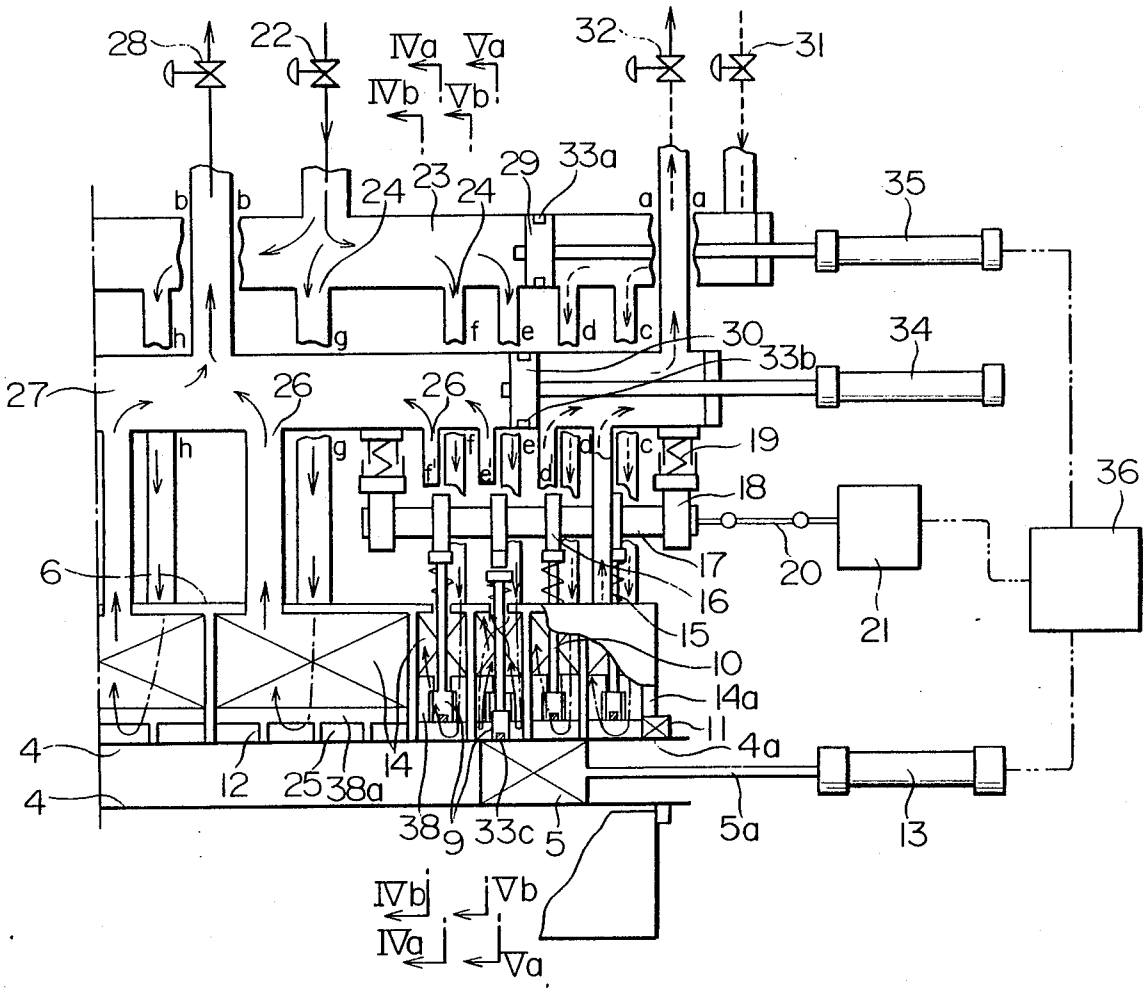
FIG. 3 is a cross-sectional view taken along the line III—III of FIG. 2, schematically illustrating a driving mechanism for an edge dam and edge dam supporting blocks in accordance with a first embodiment of the present invention.
Figure 4A:
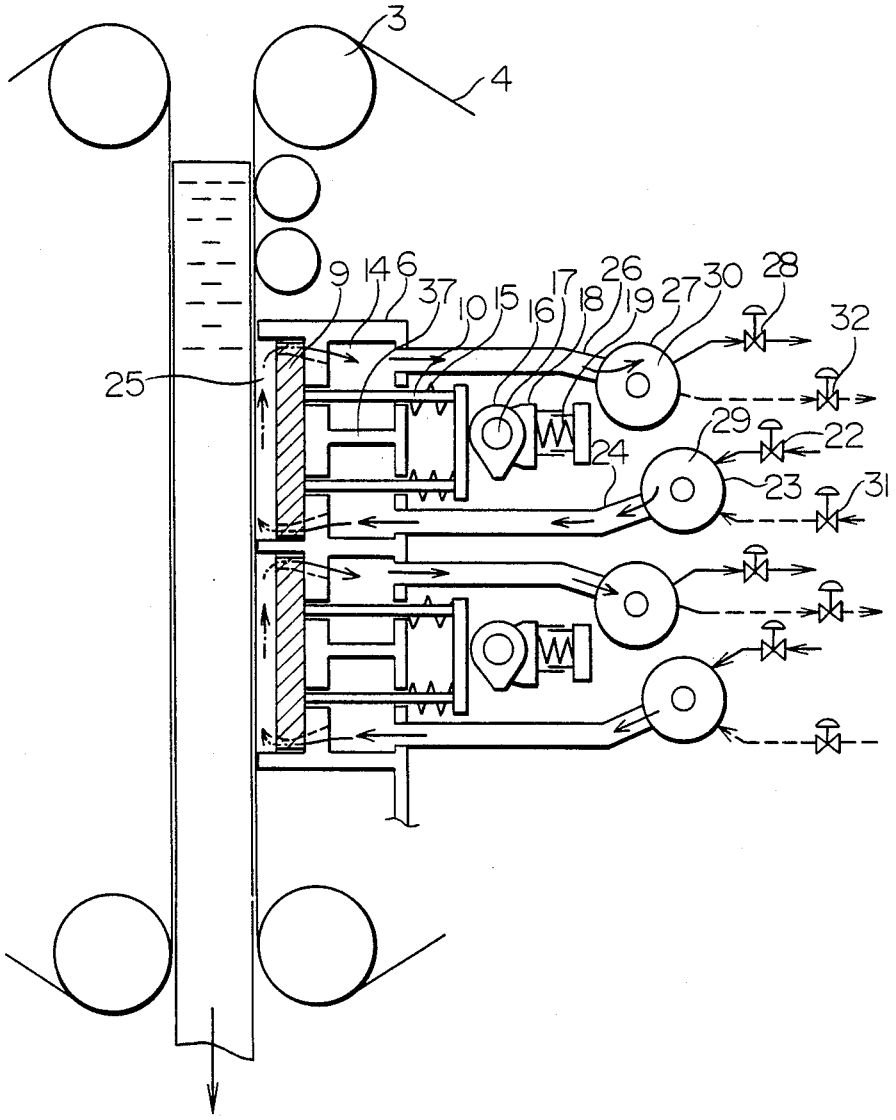
FIG. 4*a* is a cross-sectional view taken along the line IV*a*—IV*a* of FIG. 3, illustrating supporting blocks.
Figure 4B:
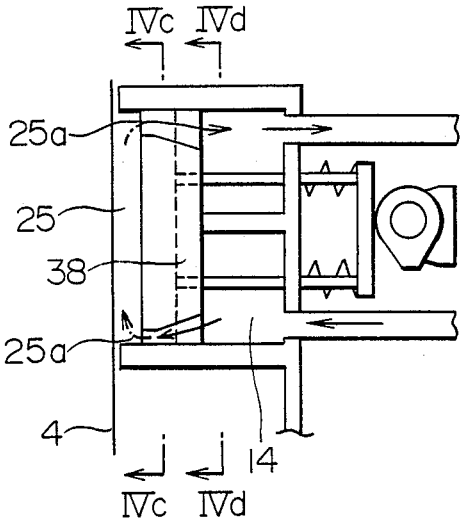
FIG. 4*b* is a cross-sectional view taken along the line IV*b*—IV*b* of FIG. 3, illustrating a cross section of a fluid flowing section.
Figure 4C:
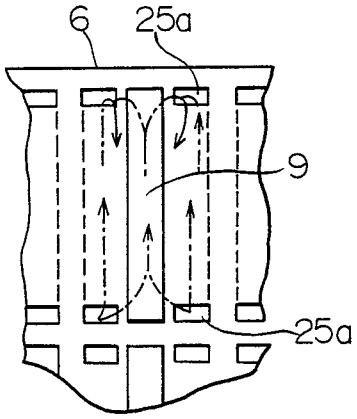
FIGS. 4*c* and 4*d* are cross-sectional diagrams that are parallel to each other and are taken along the lines IV*c*—IV*c* and IV*d*—IV*d* of FIG. 4, respectively, illustrating an internal structure of a cooling/heating chamber.
Figure 4D:
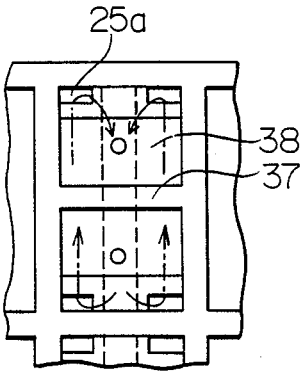
Figure 5A:
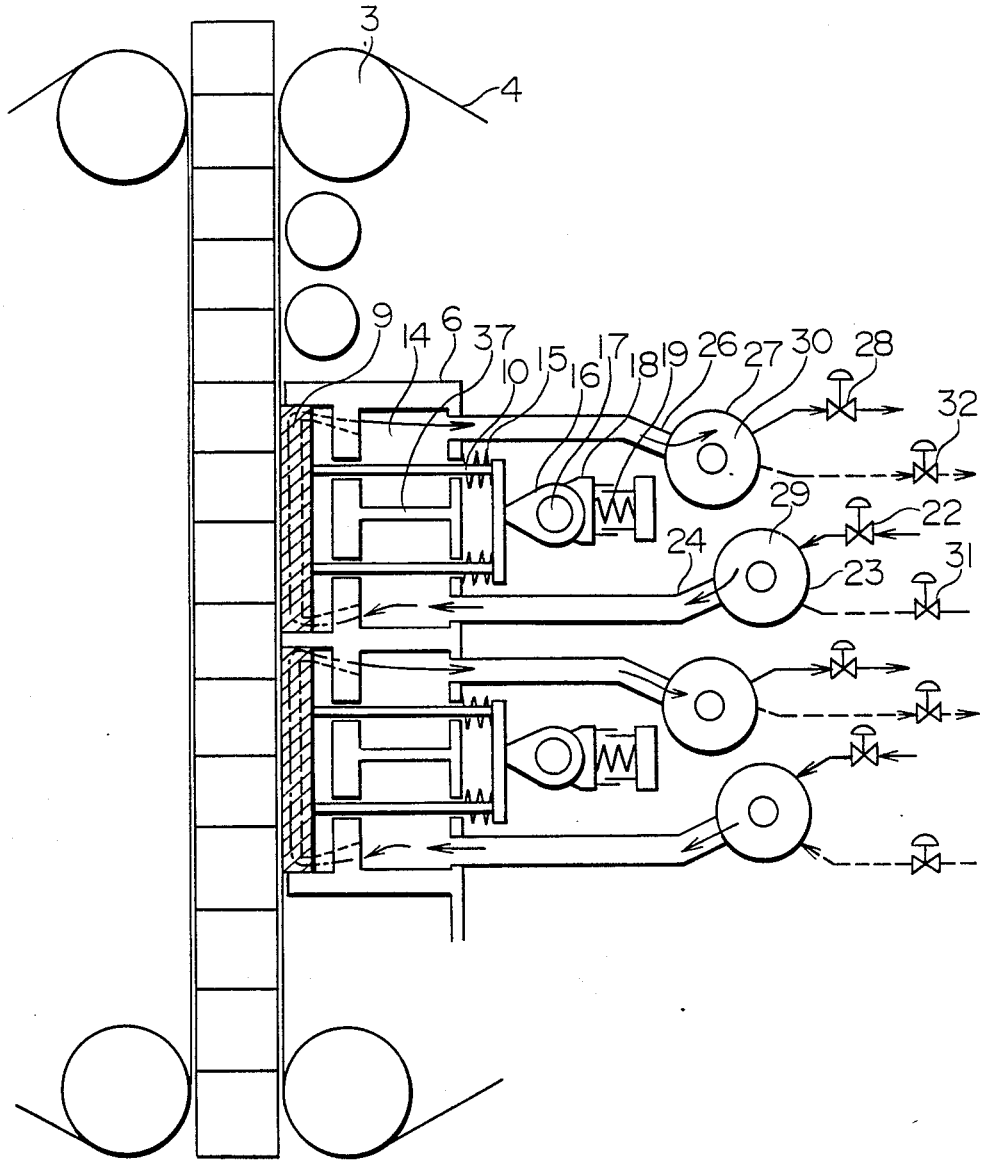
FIG. 5*a* is a cross-sectional view taken along the line V*a*—V*a* of FIG. 3, illustrating a supporting block section for supporting the belt.
Figure 5B:
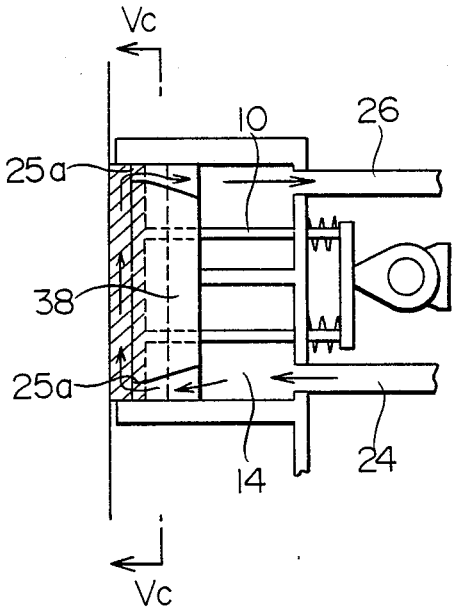
FIG. 5*b* is a cross-sectional view taken along the line V*b*—V*b* of FIG. 3, illustrating a cross section of a fluid flowing section.
Figure 5C:
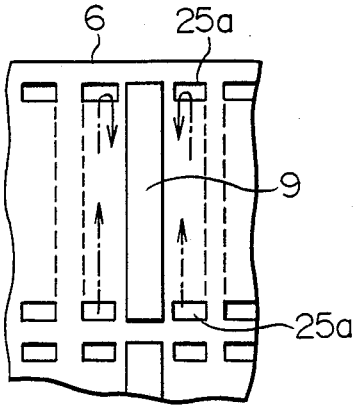
FIG. 5*c* is a cross-sectional view taken along the line V*c*—V*c* of FIG. 5*b* which is parallel with the belt, illustrating an internal structure of the cooling/heating chamber.

FIG. 3 is a top plan view of mechanisms for moving the edge dam and edge dam supporting blocks as well as devices for supplying cooling water and a heating medium. FIGS. 4 and 5 are side elevational views thereof.

As shown in FIGS. 3, 4 and 5, the edge dam 5 is pressed from the rear surface of the belt 4 by means of a plurality of edge dam supporting blocks 9 disposed in the transverse direction so as to prevent the leakage of the poured molten metal. When the width of the thin slab 7 produced is altered, the edge dam 5 is made to advance or retract in the transverse direction by means of an actuator 13. Each of the edge dam supporting blocks 9 advances or retracts in correspondence with the position of the moved edge dam 5.

Each of these edge dam supporting blocks 9 is disposed in a cooling/heating chamber 14 partitioned in the transverse direction, and has a tabular configuration elongated in the casting direction. The edge dam supporting block 9 is connected to a rod 10 which projects to outside the cooling/heating chamber 14. The edge dam supporting block 9 is urged in the direction of being separated from the belt by means of a spring 15 (see FIGS. 4 and 5). A head of the rod 10 abuts against a cam shaft 17 having an eccentric cam 16 and provided in a number indentical to the number of the edge dam supporting blocks 9. These eccentric cams 16 are disposed equidistantly in a peripheral direction such as to be offset from each other at an angle 360/n in which 360 degrees is divided by the number n of the edge dam supporting blocks 9. As a result, when the cam shafts 17 rotate, the edge dam supporting blocks 9 are consecutively made to advance or retract from outside to inside or vise versa.

In addition, a bearing 18 of the cam shaft 17 is installed on a fixed frame via a spring 19, so that this arrangement serves as a buffer in cases where the edge dam supporting block 9 is pushed away from the belt 4 as a result of the deformation of the belt 4 or occurrence of abnormal load during a pressing operation. The cam shaft 17 is connected to a drive mechanism 21 via a universal joint 20, which imparts a necessary rotational angle to the cam shaft 17.

As shown in FIGS. 4 and 5, the cooling/heating chambers 14 are arranged to be divided into a plurality of stages in the casting direction, and support the belt 4 by distributing the incremented static pressure of the molten metal.

In the drawings, the flow of cooling water is represented by a solid line; the flow of a heating medium is represented by a broken line; and the flow of these media flowing behind the rear sides of partitioning plates 37, water channel plates 38, 38*a* and the supporting blocks 9 is represented by a dot-dash line. This representation holds true of the respective embodiments which will be described below.

The cooling water passes through a pressure control valve 22 and is supplied from a supply-side header 23 to each of the cooling/heating chambers 14 through water branch channels 24 of the cooling/heating chambers 14 divided in the transverse direction. This cooling water cools the belt 4 while advancing upwardly from below through water channels 25 on the rear surface of the belt 4. The cooling water is then collected in a discharge-side piston header 27 through a discharge-side branch water channel, and is discharged outside the system through a discharge-side pressure control valve 28.

The flow rate and thickness of each of the channels are determined in such a manner that the belt 4 is subjected to necessary heat dissipation by the cooling water flowing through the water channels 25. The pressure of the cooling water is set by an entrance-side pressure regulator valve 22 and an exit-side pressure regulator valve 28 to a level which is approximately 10% below the static pressure of the molten metal.

The piston headers 23, 27 are divided in the transverse direction by their respective pistons 29, 30. The inner sides thereof are used as a supplying and discharging system for the cooling water, while the outer sides thereof are used as a supplying and discharging system for a heating medium such as steam. The supply and discharge of the heating medium are effected via a pressure control valve 31 for the heating medium, the supply-side piston header 23, the branch eater channels 24, the water channels 25, discharge-side branch water channels 26, the discharge-side piston header 27, and a discharge-side control valve 32 for the heating medium, in a manner similar to that of the supply and discharge of the cooling water.

A relevant edge dam supporting block 9 is brought into pressure contact with the belt 4 so as to partition the heating medium and the cooling medium in the transverse direction of the belt 4. At this time, if the pressure difference between the heating medium and the cooling medium is large, the cooling water or, conversely, the heating medium, will leak from a small gap between the edge dam supporting block 9 and the belt 4, such as between the frame of the cooling/heating chamber and the belt 4 (point A in FIG. 6), thereby giving rise to rendering the heating and/or cooling faulty. Accordingly, the pressure differential between the heating medium and the cooling medium should preferably be such that the pressure of the heating medium is set to 80% or below by using the pressure of the cooling water, i.e., the cooling medium, as a reference. The lower limit of the pressure of the heating medium is set to a value sufficient to allow a required amount of heating medium to flow.

Figure 6:
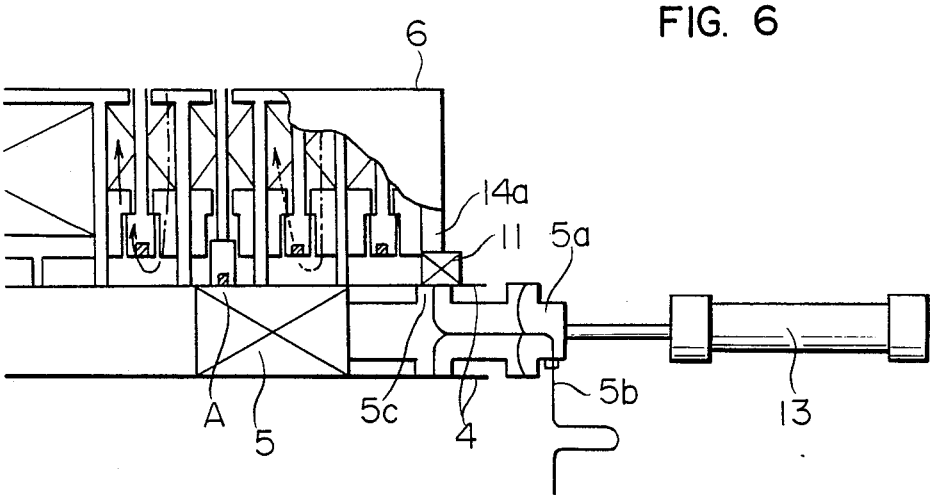
FIG. 6 is a diagram illustrating a form in which a part of the edge dam supporting member is modified.

On the other hand, if the pressure of the heating medium is increased, the belt 4 bends. Therefore, as shown in FIG. 6, which is an expanded view of the vicinity of an end portion 4*a* of the belt 4, a sliding projection 5*c* is formed in an edge dam supporting member 5*a* for supporting the edge dam 5, and if this sliding projection 5*c* is made to slide over the surface of the belt 4, the bending of the belt 4 can be effectively prevented. If a lubricant is supplied to this sliding projection 5*c* via a lubricating pipe 5*b*, the sliding of the sliding projection 5*c* with respect to the belt 4 can be performed smoothly. In addition, if a sealant 11 is installed at a tip of an outside plate 14*a* of each of the cooling/heating chambers 14, the heating medium can be prevented from spurting out from the end surface of the belt.

In addition, seals 33*a*, 33*b*, and 33*c* are respectively provided to the edge dam supporting blocks 9 and the pistons 29, 30 in order to minimize the occurrence of leakage due to a pressure differential between the cooling water and the heating medium.

These pistons 29, 30 are moved back and forth by their respective actuators 34, 35. The driving of the actuators 34, 35 is controlled by a controller 36 in such a manner as to be effected in synchronism with the actuator 13 and the drive mechanism 21. Consequently, a relevant edge dam supporting block 9 advances in response to the edge dam 5 which is moved back and forth in correspondence with the width of the thin slab to be produced. The positions of the pistons 29, 30 are adjusted in correspondence with the advanced edge dam supporting block 9. Accordingly, the supply of the cooling water to the cooling/heating chamber 14 on the inner side of the belt in the transverse direction thereof as well as the supply of the heating medium to the cooling/heating chamber 14 on the outer sides of the belt in the transverse direction thereof are effected automatically by means of the edge dam supporting blocks 9.

Figure 7:
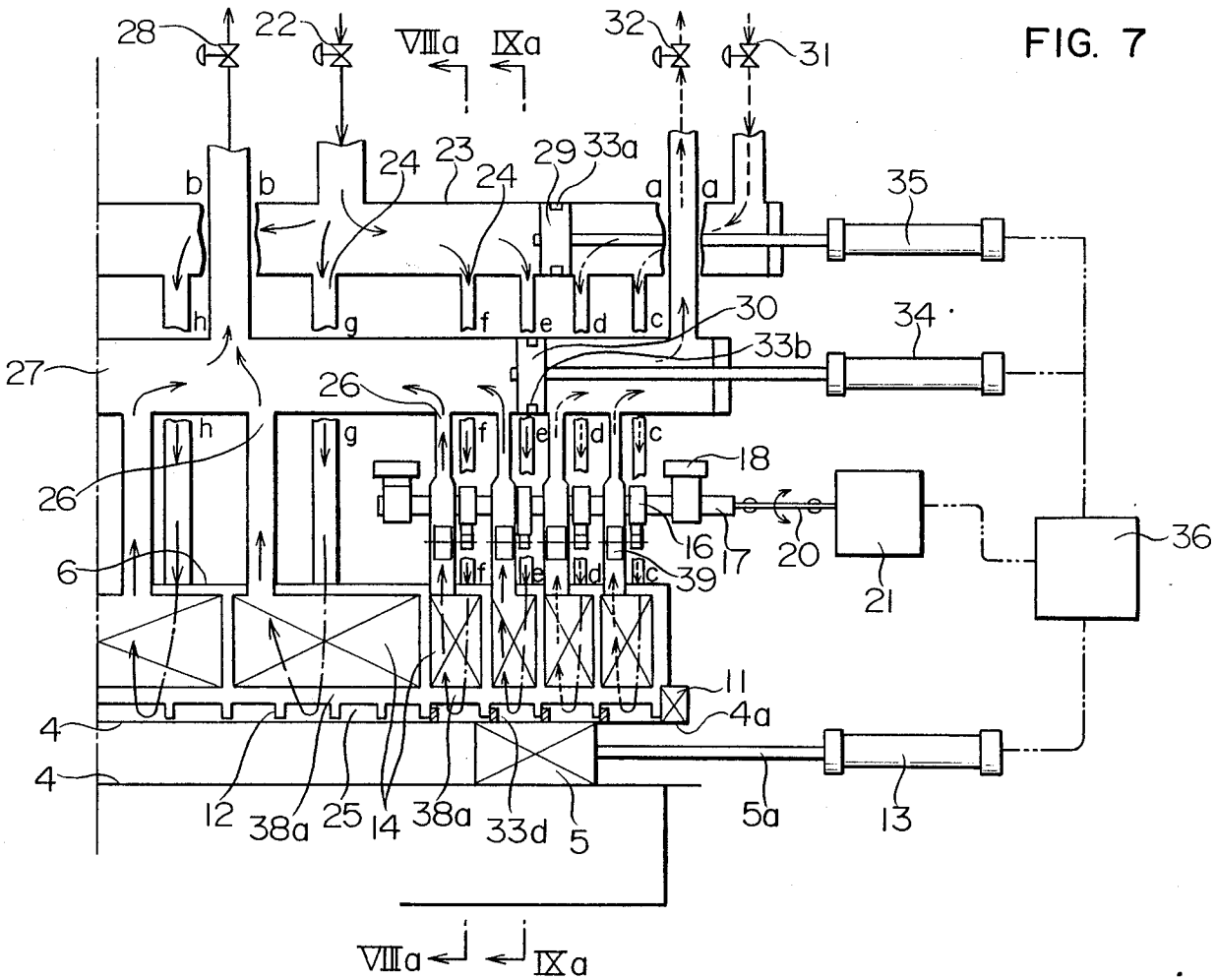
FIG. 7 is a schematic diagram illustrating the edge dam and a throttle valve operating mechanism in accordance with a second embodiment of the present invention, corresponding to the view taken along the line III—III of FIG. 2.

Referring now to FIGS. 7, 8 and 9, a second embodiment of the present invention will be described.

Figure 8A:
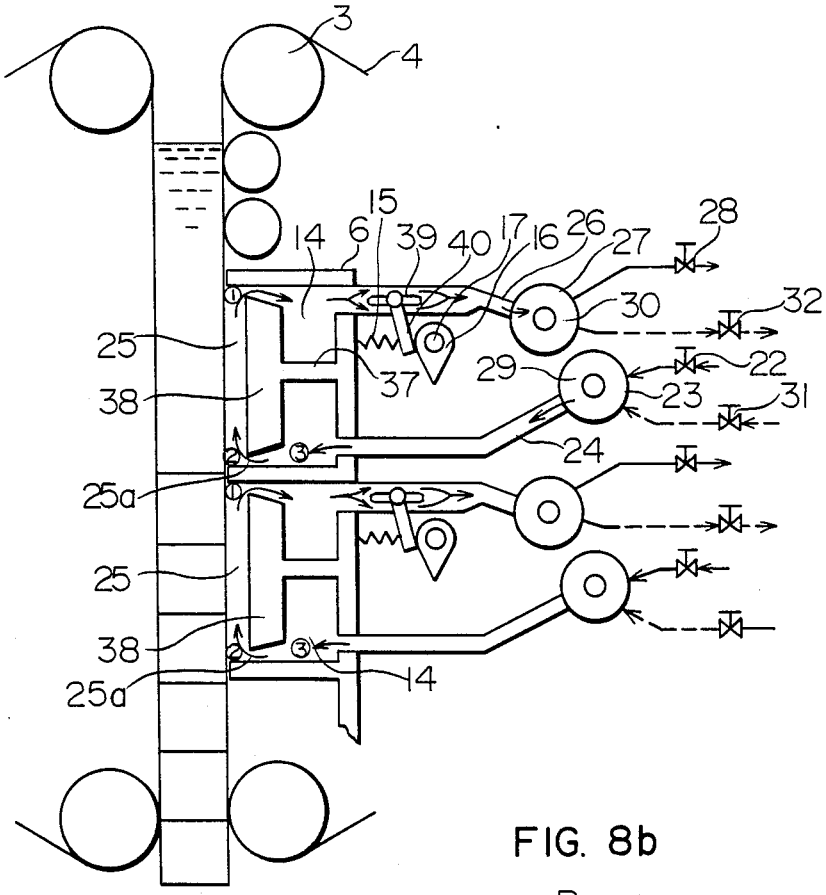
FIG. 8*a* is a cross-sectional view taken alone the line VIII*a*—VIII*a* of FIG. 7, illustrating a state in which the edge dam is not supported.
Figure 9A:
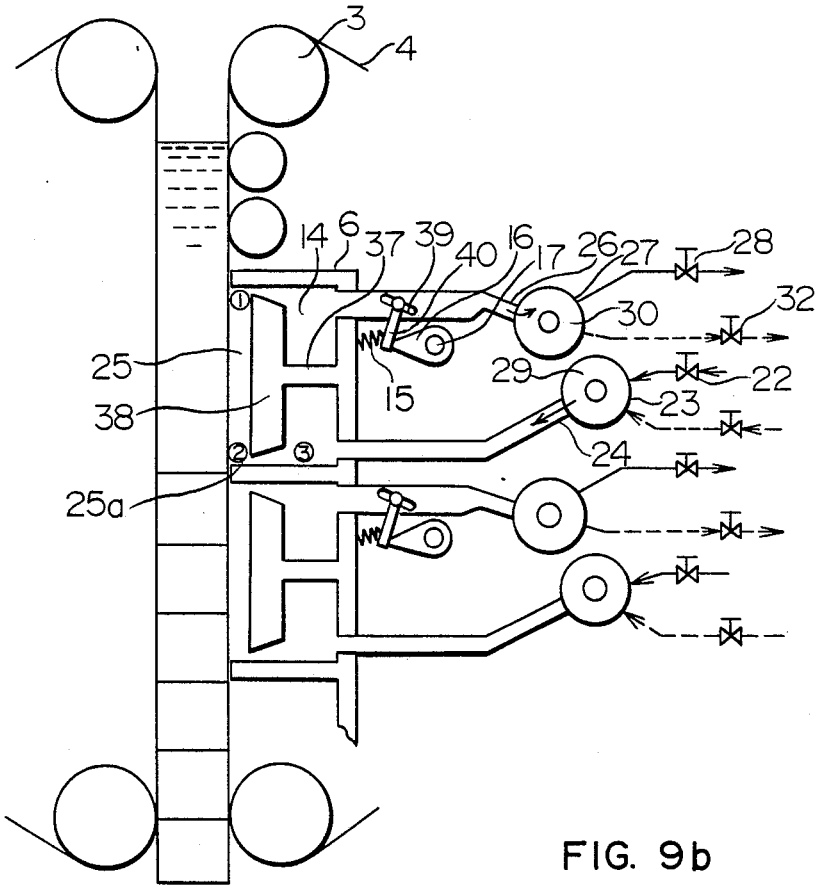
FIG. 9i a is a cross-sectional view taken along the line IX*a*—IX*a* of FIG. 7, illustrating a state in which the edge dam is being supported.
FIG. 9*b* is a diagram illustrating the distribution of hydrostatic pressure in water channels.

FIG. 7 is a top plan view illustrating the edge dam, the mechanism for raising the static pressure of the cooling water, and the devices for supplying the cooling water and the heating medium. FIG. 8*a* is a cross-sectional view taken along the line VIII*a*—VIII*a* of FIG. 7, illustrating a state in which the edge dam is not pressed, while FIG. 9*a* is a cross-sectional view taken along the line IX*a*—IX*a* of FIG. 7, illustrating a state in which the edge dam is pressed.

When the width of the thin slab 7 to be produced is changed, the edge dam 5 is advanced or retracted in the transverse direction by the actuator 13. The cooling medium passes through the pressure control valve 22, and, after further passing through the supply-side piston header 23 and the branch water channels 24, the cooling medium advances upwardly from below through the cooling/heating chambers 14 disposed on the rear surface of the belt 4, thereby cooling the belt 4. Subsequently, the cooling medium is collected through the discharge-side branch water channels 26 and is discharged to outside the system via the discharge-side pressure control valve 28.

Figure 8B:
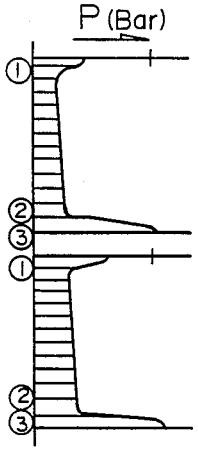
FIG. 8*b* is a diagram illustrating the distribution of hydrostatic pressure in water channels.
Figure 9B:
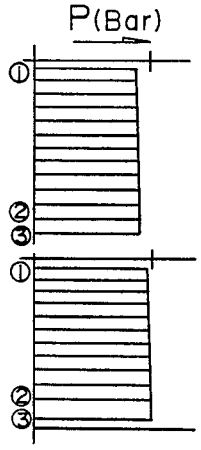

The flow rate and the thickness of each of the water channels are determined in such a manner that the belt 4 is subjected to necessary heat dissipation by the cooling water flowing through the water channels 25. At the same time, the pressure of the cooling water is controlled by the pressure control valve 22 and the discharge-side pressure valve 28 in such a manner as to teach a value which is substantially close to the static pressure of the molten metal. Meanwhile, as a throttle valve 39 in the discharge-side branch water channel 26 is throttled, the cooling/heating chamber 14 corresponding to the position of the edge dam converts part of the flow rate of the cooling water into pressure energy so as to increase the static pressure, thereby bringing the belt 4 into pressure contact with the edge dam 5. This relationship is shown in FIGS. 8*b* and 9*b* as the pressure distribution in the water channel. FIG. 8*b* shows a case in which there is no need to press the edge dam and the throttle valve 39 is open, while FIG. 9*b* shows a case in which there is a need to press the edge dam and the throttle valve 39 is closed, so that the supply pressure itself is applied thereto. The reason why the pressure drops sharply at a portion ② in FIGS. 8*a* and 8*b* is because a large pressure loss is allowed by throttling a water channel inlet-side nozzle 25*a*. The cooling/heating chambers 14 are separated from each other by means of water channel seals 33*d*, respectively.

Each of the throttle valves 39 abuts against the eccentric cam 16 through a lever 40 and is opened or closed as the eccentric cam 16 rotates. These eccentric cams 16 are arranged by being offset consecutively from each other by an angle $\theta=360/n$ in which 360 degrees are divided by a number n of channels required in changing the width. When the cam shafts 17 are rotated, the throttle valves 39 are opened or closed consecutively from the outside toward the inside or vice versa. This cam shaft 17 is connected to the driving mechanism 21, which provides a required rotational angle to the cam shaft 17.

As shown in FIGS. 2, 8 and 9, the cooling/heating chamber 14 is arranged such as to be divided into a plurality of stages in the casting direction, and support the belt 4 by distributing the incremented static pressure of the molten metal.

The piston headers 23, 27 are divided in the transverse direction by their respective pistons 29, 30. The inner sides thereof are used as a supplying and discharging system for the cooling water, while the outer sides thereof are used as a supplying and discharging system for a heating medium such as steam.

The supply and discharge of the heating medium are effected through pressure control valves 31, 32 for the heating medium, the supply-side piston header 23, the branch water channels 24, the water channels 25, the discharge-side branch water channels 26, the discharge-side piston header 27, and the discharge-side control valve 32 for the heating medium, in a manner similar to that of the supply and discharge of the cooling water.

Figure 10:
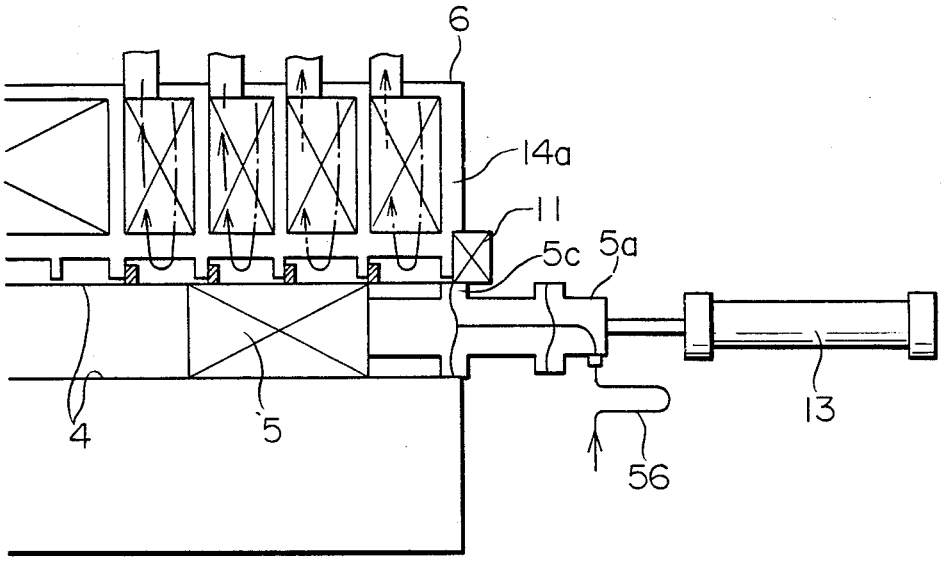
FIG. 10 is a diagram illustrating a form in which a part of the edge dam supporting block shown in FIG. 7 is modified.

If the pressure of the heating medium is increased, the belt 4 bends. Therefore, as shown in FIG. 10, which is an expanded view of the vicinity of the end portion of the belt 4, the sliding projection 5*c* is formed in the edge dam supporting member 5*a* for supporting the edge dam 5, and if this sliding projection 5*c* is made to slide over the surface of the belt 4, the bending of the belt 4 can be effectively prevented. If a lubricant is supplied to this sliding projection 5c via the lubricating pipe 5b, the sliding of the sliding projection 5c with respect to the belt 4 can be performed smoothly. In addition, if a sealant 6a is installed at a tip of the outside plate 14a of each of the cooling/heating chambers 14, the heating medium can be effectively prevented from spurting out from the end surface of the belt.

The pistons 29, 30 are moved back and forth by their respective actuators 34, 35. The driving of the actuators 34, 35 is controlled by the controller 36 in such a manner as to be effected in synchronism with the actuator 13 and the drive mechanism 21. Consequently, the throttling valve 39 in the cooling/heating chamber 14 is throttled in response to the edge dam 5 which is advanced or retracted in correspondence with the width of the thin slab to be produced, and the positions of the pistons 29, 30 are adjusted in correspondence with the throttled cooling/heating chamber 14. Accordingly, the separation of the cooling and pressurizing functions of the cooling water as well as the separation of the cooling water and the heating medium can be effected automatically.

Figure 11B:
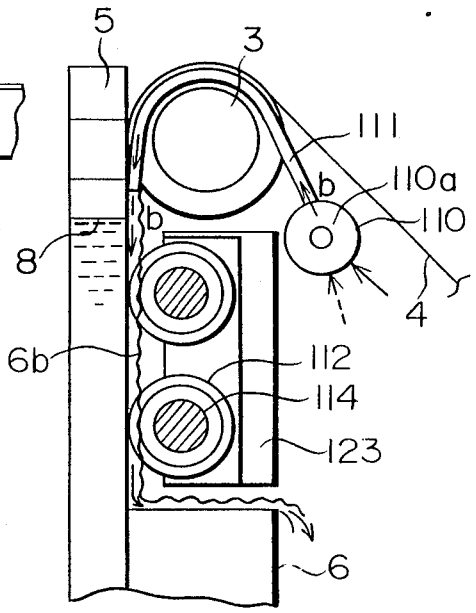
FIG. 11*b* is a cross-sectional view taken along the line XI*b*—XI*b* of FIG. 11*a*.
Figure 11A:
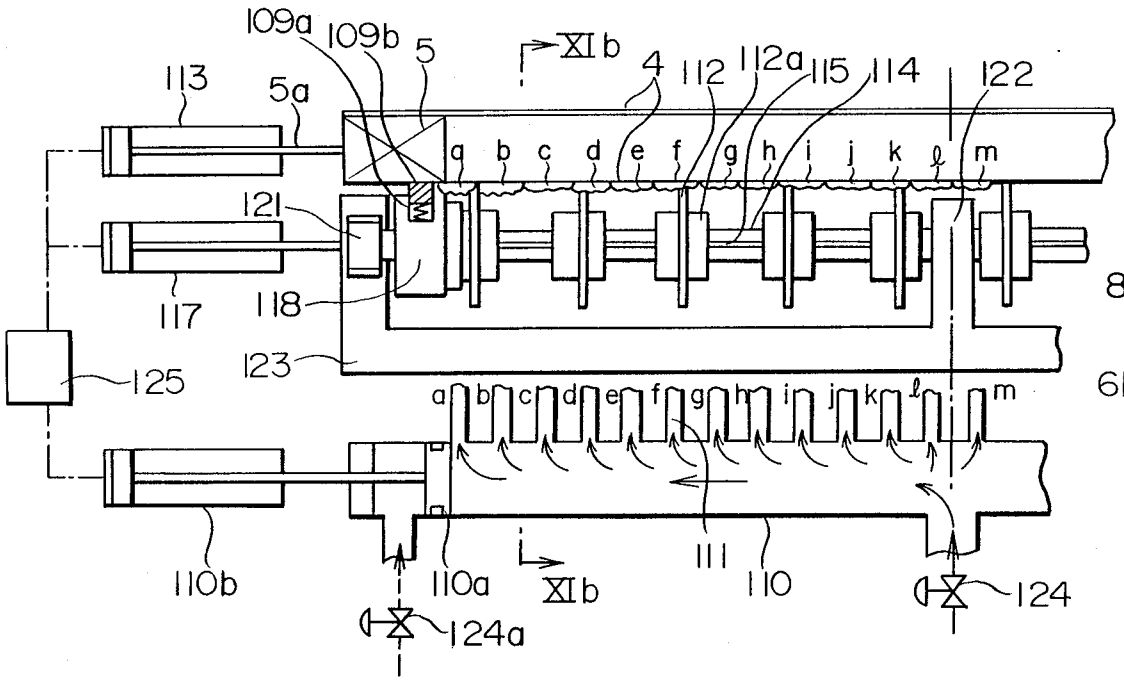
FIG. 11*a* is a diagram schematically illustrating the edge dam, the belt supporting mechanism, and a cooling/heating medium supplying mechanism in accordance with a third embodiment of the present invention, the diagram being a cross-sectional view taken along the line XI*a*—XI*a* of FIG. 2.
Figure 12:
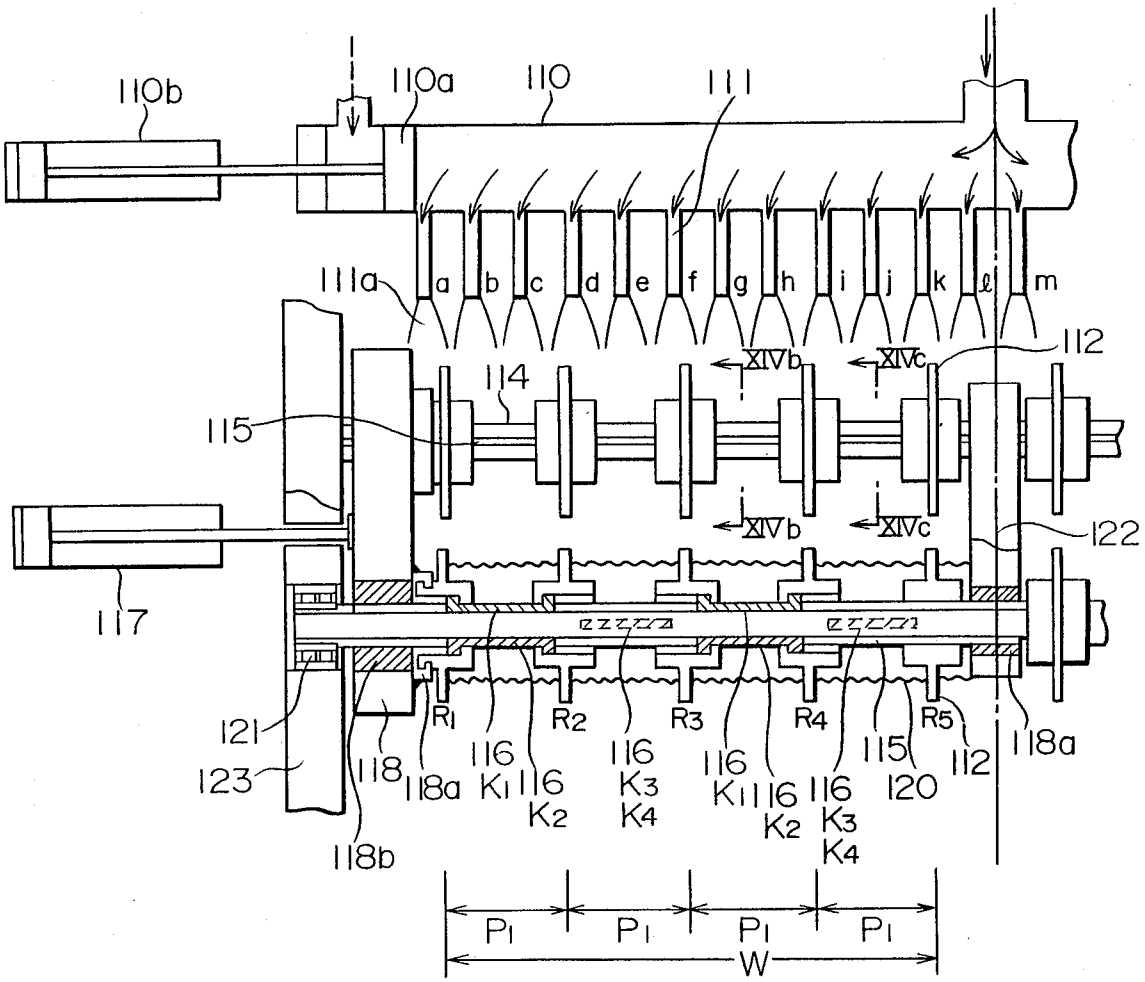
FIG. 12 is a diagram of a cooling section as viewed from a rear surface thereof, illustrating a state in which the casting width is set to a maximum.
Figure 13:
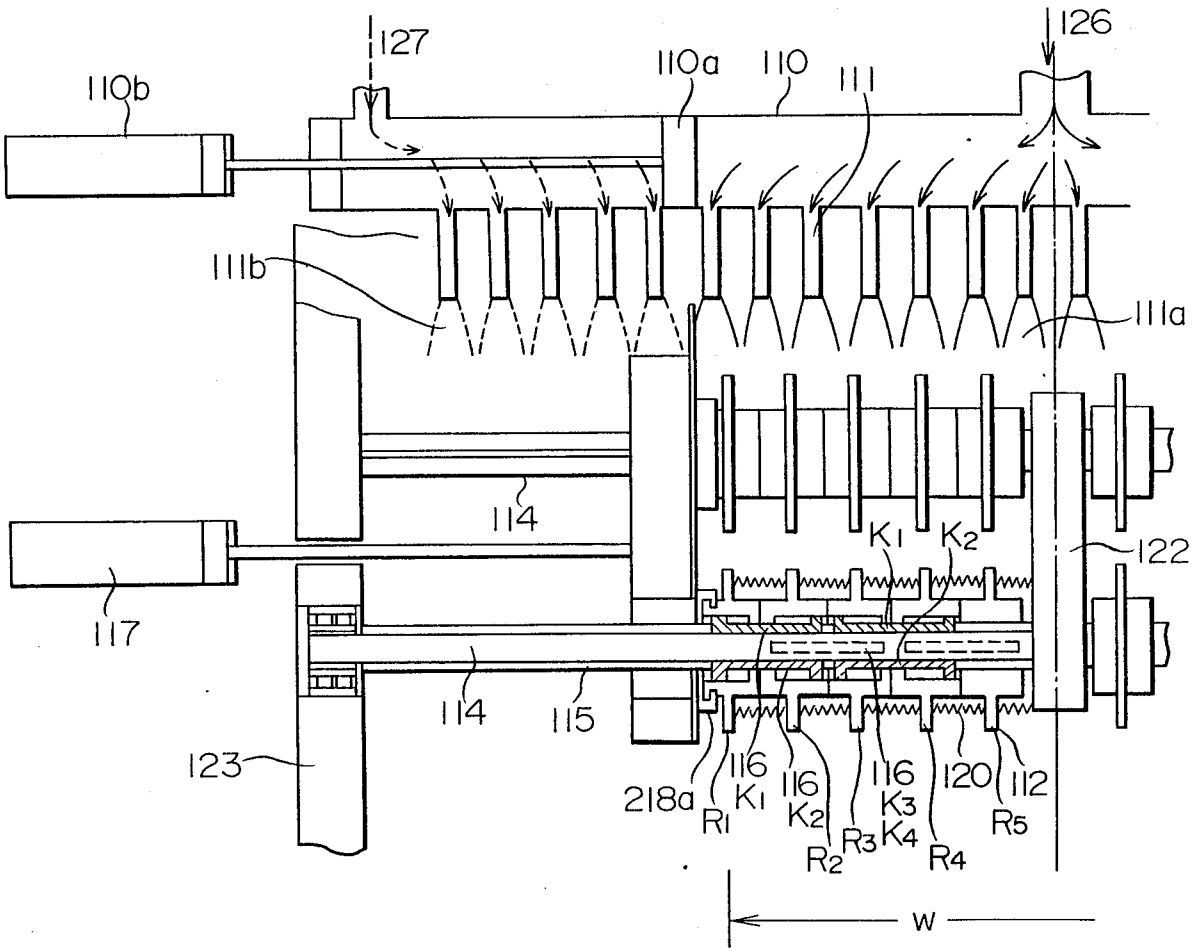
FIG. 13 is a diagram similar to FIG. 12, illustrating a state in which the casting width is set to a minimum.

FIG. 11a is a top plan view of the edge dam 5, an edge dam supporting block 118, and a group of disk rolls 112 for supporting the belt in accordance with a third embodiment of the present invention. FIGS. 12 and 13 are rear views thereof. Also, FIG. 11b is a side view taken along the line XI*b*—XI*b* in FIG. 11a.

In this embodiment, supporting blocks 118 which are movable in the transverse direction of the belt to bring the edge dam 5 into close contact with the belt 4 are provided on the rear surface of the belt 4. In addition, the group of disk rolls 112 for maintaining the flatness of the belt are also provided on the rear surface of the belt. This supporting block 118 moves in synchronism with the edge dam 5, while the group of disk rolls 112 are capable of automatically expanding or shrinking in the transverse direction of the belt by following the movement of this supporting block 118.

Figure 14A:
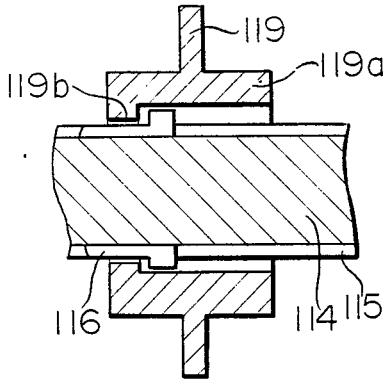
Figure 14B:
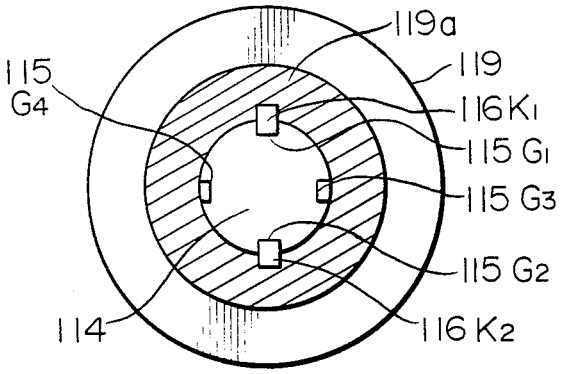
Figure 14C:
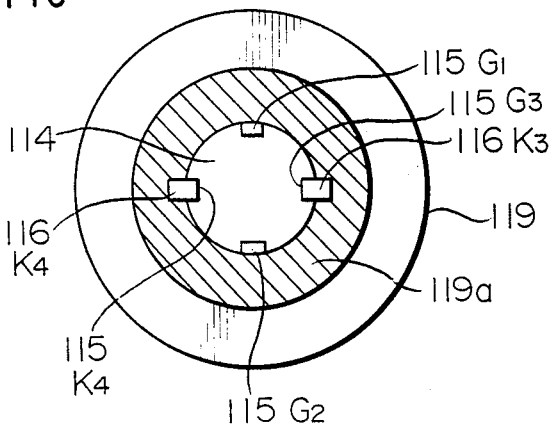

FIGS. 11a and 12 illustrate a state in which the casting width is maximum, while FIG. 13 illustrates a state in which the casting width is minimum. FIG. 14a is an enlarged view showing a disk roll 119, shaft 112 and a key 116. FIG. 14b is a cross-sectional view taken along the line XIV*b*—XIV*b* of FIG. 12, while FIG. 14c is a cross-sectional view taken along the line XIV*c*—XIV*c* of FIG. 12. The edge dam 5 is moved in the transverse direction by a driving mechanism 113, and is pressed via the belt 4 by the supporting block 118 which is moved by a driving mechanism 117 in synchronism with the movement of the edge dam 5.

Each of the disks of the group of disk rolls 112 is individually inserted through a shaft 114. However, the shaft 114 is provided with keyways 115 in the axial direction thereof, and keys 116 are slidably embedded therein. These keys are respectively provided with hook-shaped projections at opposite ends thereof and are connected to adjacent disks by means of retainers 119b respectively projecting inwardly of bosses 119a to which the disks are provided (see FIG. 14a).

Keys $K_1$, $K_2$ in keyways $G_1$, $G_2$ serve to connect together disks $R_1$, $R_2$ as well as $R_3$, $R_4$, and the arrangement is such that intervals therebetween will not be widened by more than a fixed length. Similarly, keys $K_3$, $K_4$ in keyways $G_3$, $G_4$ serve to connect together disks $R_2$, $R_3$ as well as $R_4$, $R_5$. Accordingly, the disks $R_1$–$R_5$ are arranged with a maximum width W restricted by the lengths of the keys.

The outermost disk R1 is restrained with respect to the supporting block 118 by a restraining bracket 118a in the transverse direction, but has a rotatable structure and slides in the transverse direction in synchronism with the supporting block 118.

When the width is reduced, the supporting block 118 is moved up to a position corresponding to the moved edge dam 5 by means of the driving mechanism 117. At this time, each of the bosses 112a slides along the shaft 114 in the transverse direction, so that the width can be reduced until the bosses are respectively brought into contact with adjacent bosses at w. The keys K1–K4 slide relative to the bosses, and are respectively accommodated in the bosses. FIG. 13 illustrates a state a this juncture.

When the width is expanded, if the supporting block 118 is conversely drawn out by the driving mechanism 117, the bosses can be pulled out consecutively by the keys $K_1$, $K_2$, $K_3$, $K_4$ in the order of $R_1$, $R_2$, $R_3$, $R_4$, thereby spreading the disk rolls to a necessary width.

Here, the intervals between the adjacent bosses do not necessarily become uniform in both the maximum or minimum ranges thereof. To cope with this situation, however, the intervals between the adjacent disks and the lengths of the bosses are determined in such a manner that no adverse effect is exerted on the flatness of the belt in the maximum or minimum ranges.

Through the above-described measures, the group of disk rolls 112 can be automatically expanded or shrunk in correspondence with the movement of the edge dam 5.

A disk pitch P1, a length of the rotary boss $P_2$, and the difference between a maximum width W and a minimum width w are determined as follows:

$$(W-w)/2=P_1(n-1)-P_2(n-1)=(n-1)(P_1-P_2)$$

Since the disks and keys are immersed in the cooling water, a material which does not corrode, such as stainless steel, is preferably selected for these members, and it is effective to seal the respective intervals between the adjacent disks with belows 120 formed of rubber or the like for sealing so as to prevent the entrance of dust or water. Since the shaft 114 is connected to the disks by means of the keys 116, the shaft 114 rotates together and is supported by an end-portion bearing 121 and an intermediate bearing 122. The supporting block 118 is rotatable slidably around the shaft 114 by means of a bush 118b.

The supporting block 118 has a structure in which an abrasion resistant sliding member 109b is incorporated, and the supporting block 118 slides while being pressed against the belt 4 by means of a spring 109a. Accordingly, a reactionary force for supporting the belt 4 is imparted to the shaft 114, and is supported by a frame 123 via bearings 121, 122.

Furthermore, a piston header 110 is provided in the same way as in the first and second embodiments so as to allow the cooling water to flow on the inner side of the supporting block 118 and the heating medium on the outer side thereof in conjunction with the movement of the edge dam 5. A piston 110a is adapted to follow the movement of the edge dam 5 by means of an actuator 110b.

Consequently, the fluids which have respectively passed through the flow-rate regulator valve 124 for cooling and the flow-rate regulator valve 124a for heating medium pass through jet pipes 111 with the piston marking a boundary, and are jetted out to the belt in the form of jets 111*a*, thereby cooling the belt.

In a belt mold, the fact that the temperature of the belt becomes high and deformed when it is brought into contact with the molten metal is important in relation to the quality of the castings. Therefore, it is important to develop a means for preventing the deformation of the belt.

First, a following detailed investigation was conducted on the behavior of the belt deformation of the twin belt type continuous casting machine. Only the unit provided on one side of the belt mold was used, and all the cooling water in the unit was removed. The surface of the belt was then heated by an electric heater, and the relief height (caused by deformation) of the belt was examined with a contact type displacement meter while the width of the heated belt was varied to various widths.

The height of the belt mold was 3.0 m (a distance between the centers of an entrance-side roll and an exit-side roll), the widths of the belt were 1,500, 1,800, 2,200, and 2,500 mm, and the thickness of the belt was 1.2 mm. In terms of the average cross section of the belt, the tension of the belt was 5 and 15 kgf/mm$^2$, and a test was performed while moving the belt at a rate of 2 m/min.

Two locations at predetermined portions in the transverse direction of the test belt were assumed to be places where the edge dams exist. The displacement of the belt was restrained by means of separately prepared belt pressing tools at the selected two locations in units of 100 mm-portions in the transverse direction over a range extending from the belt entrance-side roll to the exit-side roll. The area of the belt where these tools were located was not heated.

It was assumed that the area of the belt between these tools was the casting width, and that the distance (2.5 m) in the longitudinal direction of the belt from the position 500 mm below the entrance-side roll to the exit-side roll was the area in which the belt came into contact with the metal being cast. The temperature of the belt in this area was controlled by adjusting the input voltage of the electric heater in such a manner that the temperature thereof was held in the range of 130° to 150° C.

Water at 20° C. was sprayed to the portion of the belt immediately downstream of the exit-side roll so as to cool the belt. In addition, as for the portion of the belt immediately upstream of the entrance-side roll, an electric heater was used to provide different temperature settings for a nonheated case (belt temperature: 20° C.) and a heated case (belt temperature: 130°-150° C.) in accordance with the test conditions. Furthermore, electric heaters were respectively provided at opposite side portions of the belt and were used selectively to provide different temperature settings for the nonheated case (noncontrolled) and the heated case (130°-150° C.) in accordance with the test conditions.

Figure 15:
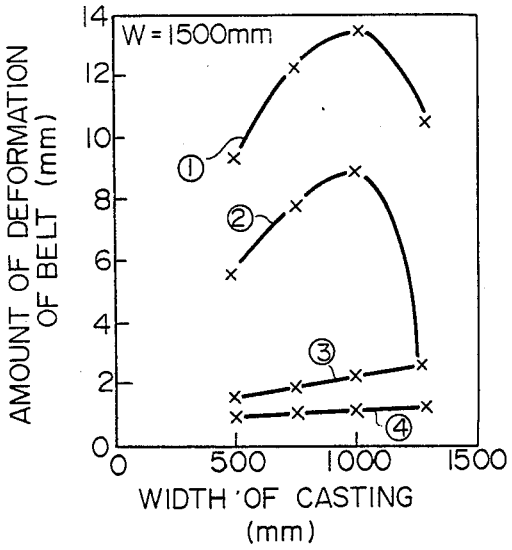
FIGS. 15, 16 and 17 are graphs on data obtained by simulation tests, illustrating the effects of tension applied to the belts and the use of side heaters and a preheater.
Figure 16:
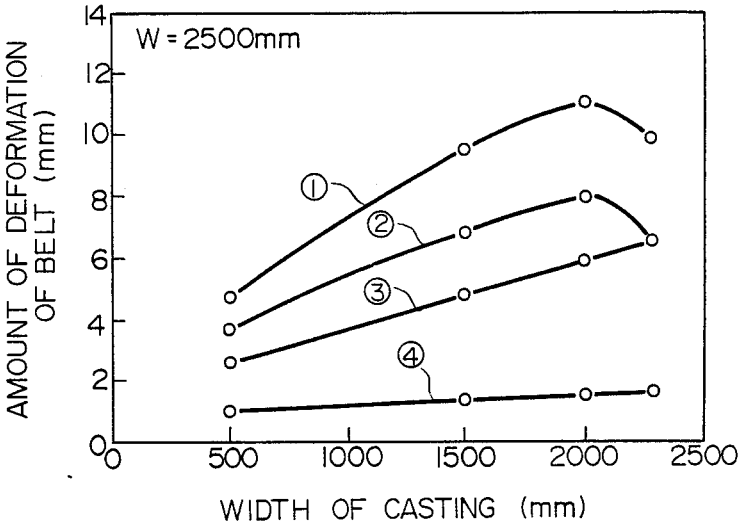

Two examples of the test results are shown in FIGS. 15 and 16.

FIG. 15 shows a case where the belt width was 1,500 mm, while FIG. 16 shows a case where the belt width was 2,500 mm.

In these graphs, Line ① is the case in which the belt tension was 5 kgf/mm$^2$, while line ② is the case in which the belt tension was 15 kgf/cm$^2$. In each case, the preheating of the belt and the heating of the side end portions of the belt were not performed. Line ③ is the case in which the tension was set to 15 kgf/mm$^2$, and the heating of the side end portions was performed, while line ④ is the case in which the belt was preheated immediately upstream of the entrance-side roll in addition to the conditions of line ③. In the respective cases, the width of the portion which was assumed to be the casting width and the amount of belt displacement thereof are shown.

FIG. 16 is the case of a 2,500 mm belt width, and the conditions of lines ① to ④ are the same as those described above. The belt displacement was maximum when the belt width was 1,500 mm and the casting width was 1,000 mm, i.e., under the condition in which cold frames of 250 mm each were provided on both sides of the belt (marked x in line ① of FIG. 15) and the amount of displacement was 13.5 mm. This was the case where the belt tension was set to 5 kgf/mm$^2$. However, when the belt tension was set to 15 kgf/mm$^2$, the amount of belt displacement declined to 9.0 mm, and when the heating of the side end portions of the belt was performed in addition to those conditions, the amount of belt displacement was further reduced, as shown in line ③. Furthermore, if the preheating of the belt was performed in addition to the aforementioned conditions, the amount of helt displacement was even further reduced, as shown in ④. Substantially the same results were exhibited when the belt width was 2,500 mm.

Also, a similar test was conducted in the cases of the belt widths of 1,800 and 2,200 mm.

Figure 17:
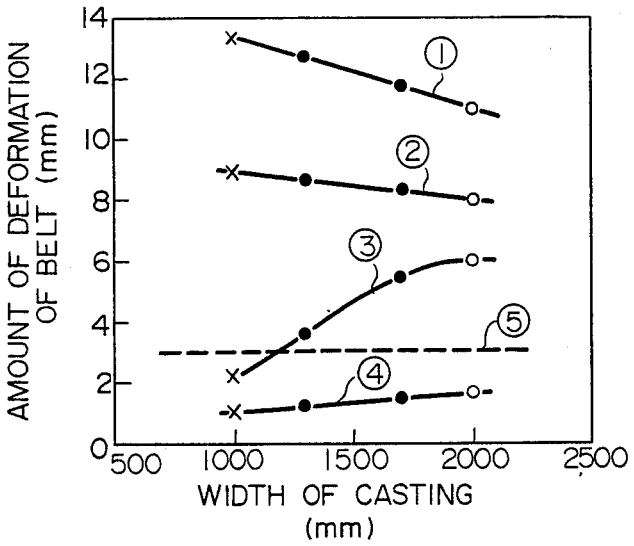

From these results, the results of cases where the casting width was 500 mm narrower than the belt width were rearranged and are shown in FIG. 17.

Line ⑤ is also shown in FIG. 17, and indicates an allowable limit of the amount of belt displacement in the light of the quality of castings, which was obtained as a result of a test which will be described below. Namely, if the amount of belt displacement is 3 mm or less, favorable castings can be obtained. In this graph, it can be seen from the relationship between the lines ③ and ⑤ that, in the case of the casting width of less than 1,200 mm, the amount of belt displacement can be held down to 3 mm or less through the heating of the side end portions of the belt under the condition in which, as for the belt width, a reserve width of 500 mm is provided to the casting width. On the other hand, in the case of the casting width of 1,200 mm or above, the heating of the belt before its entering the entrance-side roll, i.e., preheating, in addition to the heating of the side end portions of the belt, becomes an essential condition for holding down the amount of belt displacement to 3 mm or less.

Figure 18:
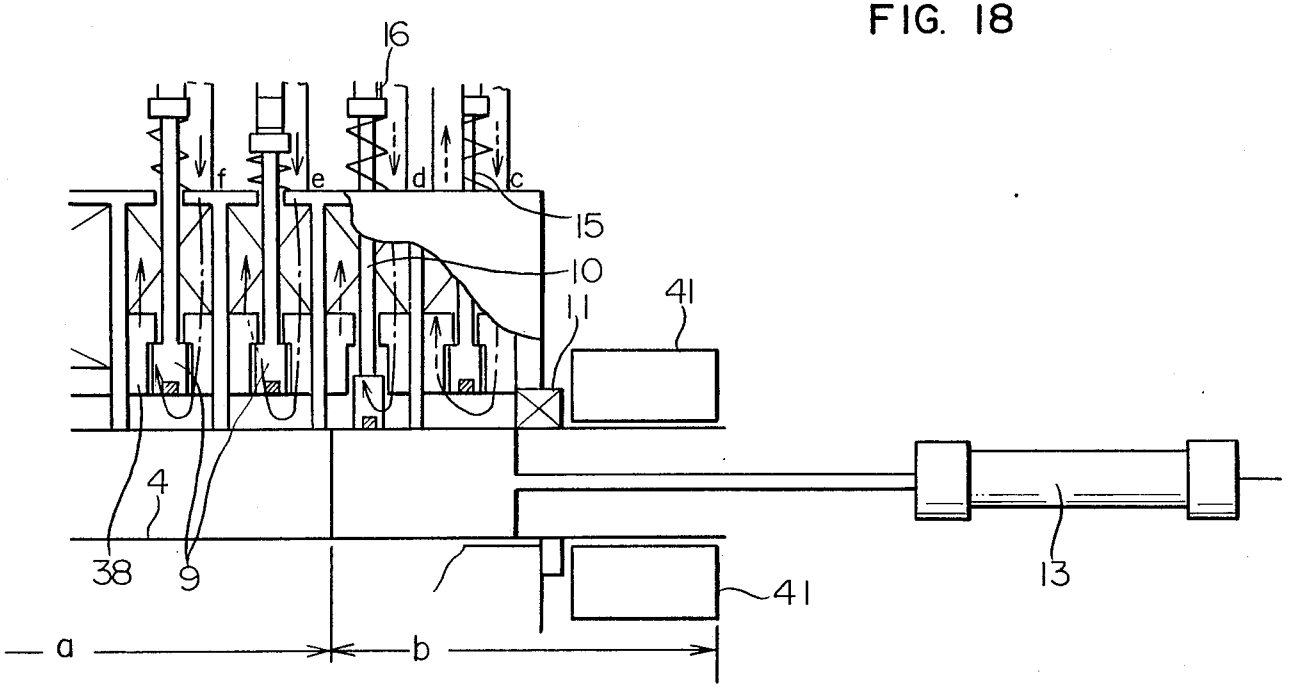
FIG. 18 is a diagram illustrating an embodiment in which side end portions of the belts are heated by an electromagnetic induction heater.

FIG. 18 shows a means for heating the side end portions of the belt in accordance with a fourth embodiment of the present invention. In this embodiment, the edge dam supporting blocks 9, the sealant 11, and induction heating coils 41 for heating side end portions are provided in the range of b in the transverse direction of the belt 4. The dimension of this induction heating coil 41 in the transverse direction of the belt may be determined appropriately in the light of the dimension of the portion b of the belt 4, a heating width necessary for eliminating a temperature difference, and the like. In this embodiment, the width of the induction heating coil 41 is set to 120 mm. In addition, the dimension of the induction heating coil 41 in the longitudinal direction of the belt is set to 500 mm, and, in the illustrated example, a total of four induction heating coils are provided on side end portions of the belt 4 in the longitudinal direction of the belt. A required electric current is supplied to each of the induction heating coils 41 from a power source (not shown), whereby the side end portions of the belt 4 are heated.

Figure 19:
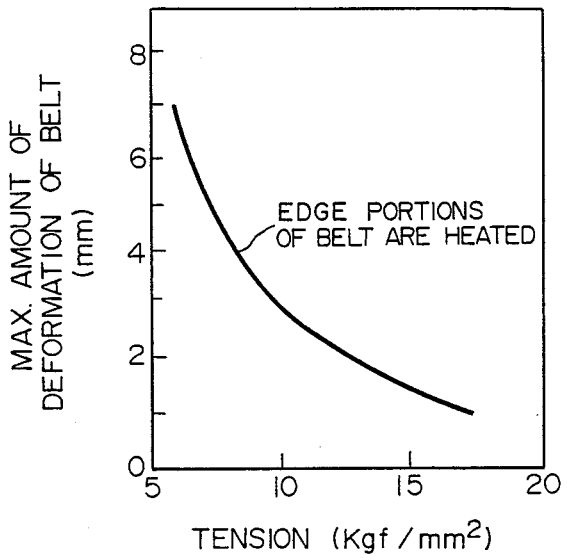
FIG. 19 is a graph showing the effects of tension applied to the belts and the heating of the side end portions of the belt on the maximum amount of deformation.

By using the twin belt type continuous casting machine having the above-described arrangement with a belt mold length of 3.0 m, a steel thin slab having a width of 600 mm and a thickness of 50 mm was produced from 1,550° C. molten steel having a composition of plain carbon steel while tension was being applied to the belt 4. As for the belt 4, a steel belt with a width of 1,040 mm and a thickness of 1.5 mm was used, and was heated to 120° C. on the average with respect to the range of the belt 4 up to 120 mm from side ends thereof. FIG. 19 is a graph illustrating the relationship between the tension applied to the belt 4 and a maximum amount of deformation of the belt 4 occurring at that time. In addition, the amount of deformation of the belt 4 was measured by an eddy current displacement meter, and the maximum amount of displacement along the transverse direction thereof was set as the ordinates in FIG. 19.

Figure 20:
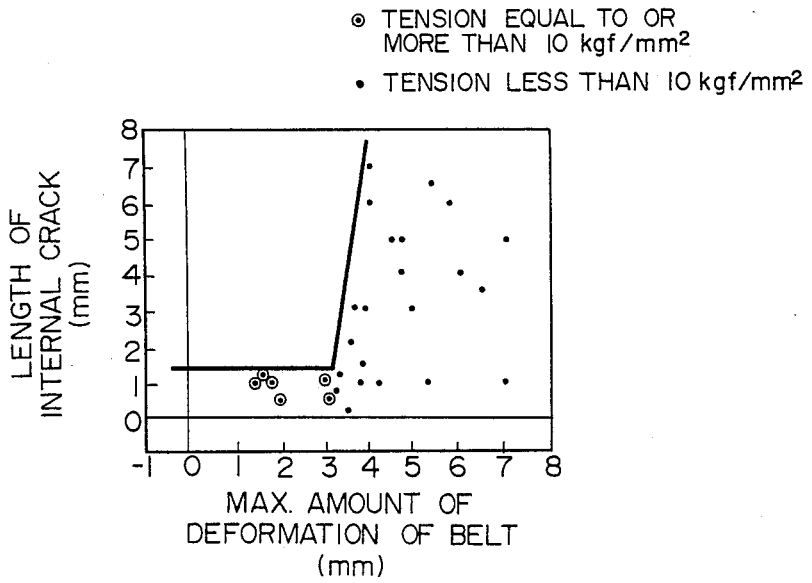
FIG. 20 is a graph illustrating the relationship between the maximum amount of belt deformation and the quality of castings (length of internal cracks)

As is apparent from FIG. 19, the deformation of the belt 4 can be restrained substantially when tension is applied to the belt while the side end portions of the belt 4 are being heated. The deformation of the belt 4 is such that it also exerts an adverse effect on cracks that occur inside the thin slab. FIG. 20 is a graph illustrating the relationship between the amount of deformation of the belt 4 and the length of internal cracks.

As described above, the reason why internal cracking occurs in large quantities in correspondence with the deformation of the belt 4 is presumably attributable to the fact that the conditions for generation and growth of a shell are disturbed by the deformation thereof, and that portions where local stress is liable to concentrate occur in the shell. The enlargement of the internal cracks can be checked by setting the amount of deformation of the belt 4 to 3 mm or less. This amount of deformation of 3 mm or less can be obtained by setting the tension applied to the belt 4 to 10 kgf/mm$^2$ or above, as is apparent from FIG. 19. The lower limit of the tension in the present invention is thus determined.

In addition, it is necessary that the temperature at which the side end portions of the belt are heated be set to 100° C. or above. If the heating temperature of the side end portions is less than 100° C., it is impossible to reduce the temperature difference of the belt in the transverse direction thereof, and the effect of preventing the widthwise deformation is small. Meanwhile, if the heating temperature for the side end portions of the belt exceeds 250° C., there is the risk that the steel belt itself yields with the tension applied thereto, so that it is desirable to set the upper limit of the heating temperature to 250° C.

Incidentally, the dimension of the induction heating coil 41 in the longitudinal direction of the belt can be set appropriately in the light of design of the coil. In addition, a plurality of induction heating coils 41 may be provided at appropriate intervals at the side end portions of the belt in the longitudinal direction of the belt.

As for the belt, a steel sheet having a tensile strength of 50 kgf/mm$^2$ or more is frequently used, but it is also possible to use a belt formed of stainless steel, steel with a high nieckel or chromium content, or other high alloy steel which has a tensile strength of 40 kgf/mm$^2$ or above.

The above test was conducted for the case of a casting width of 600 mm, and a casting test was then performed for the case of a wide casting width, i.e., 1,900 mm.

Figure 21:
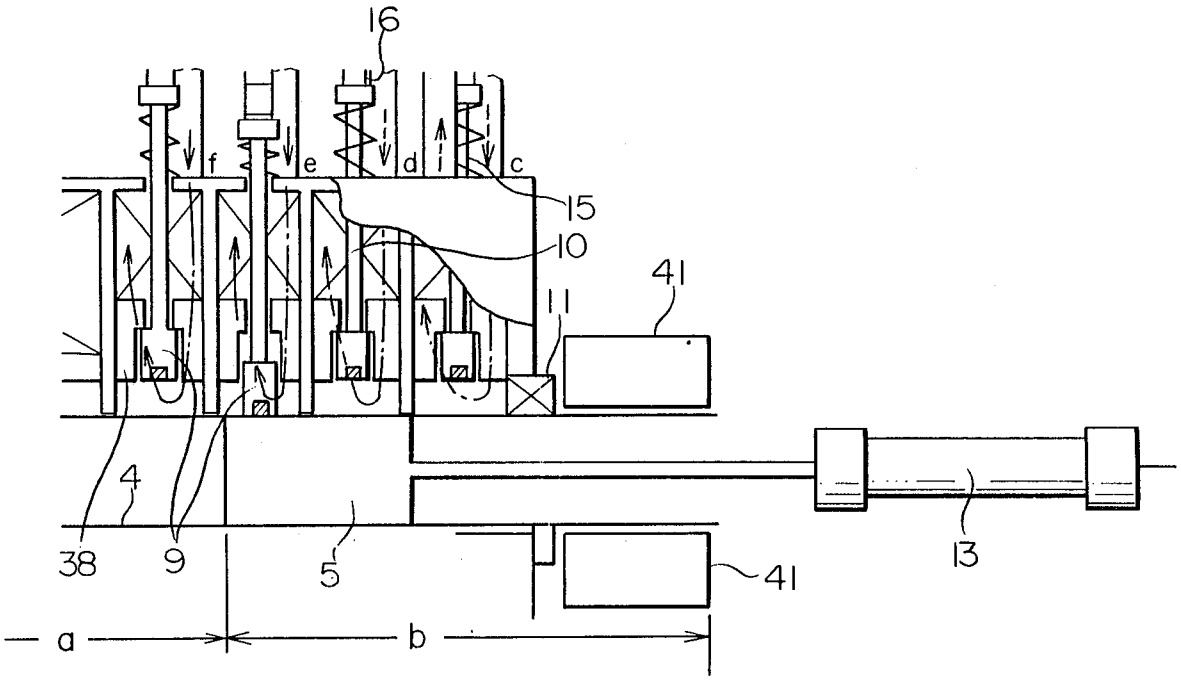
FIG. 21 is a diagram illustrating an embodiment in which the portion of the belt disposed inwardly of the side end portions thereof is heated with steam by using the electromagnetic induction heater.

The width of the belt used in the belt mold was 2,480 mm, and the thickness of the sheet was 1.2 mm. The structure of a side end portion of the belt is shown in FIG. 21. Namely, the arrangement includes the portion of the belt up to 100 mm from the side end of the belt which is heated to 100°-120° C. by an electromagnetic induction heater 41; a continuing 30 mm portion which is made to abut against the sealant 11; as for a further 50 mm portion, steam is allowed to enter the cooling/heating chambers 14 on the rear surface of the belt so as to heat that portion to 110°-120° C.; a still further 90 mm portion is made to abut against a copper-made edge dam whose temperature is controlled to 110°-120° C.; and a further 1,900 mm portion is made to abut against the casting metal. Of the portion of the belt which abuts against the edge dam, a 50 mm-portion adjacent to the side end of the belt is heated by 110°-120° C. by heating with steam, while, of the portion of the belt which abuts against the edge dam, the rear surface of a 40 mm-portion of the belt is cooled by the cooling water. In addition, the rear surface of the belt portion which contacts the molten metal is cooled by the cooling water.

Furthermore, an additional test condition was established by providing the following two cases; one in which, before the belt contacts the entrance-side roll, the belt is heated to 120°-140° C. by a belt preheater 60 shown in FIG. 2; and another in which preheating is not performed.

Figure 22:
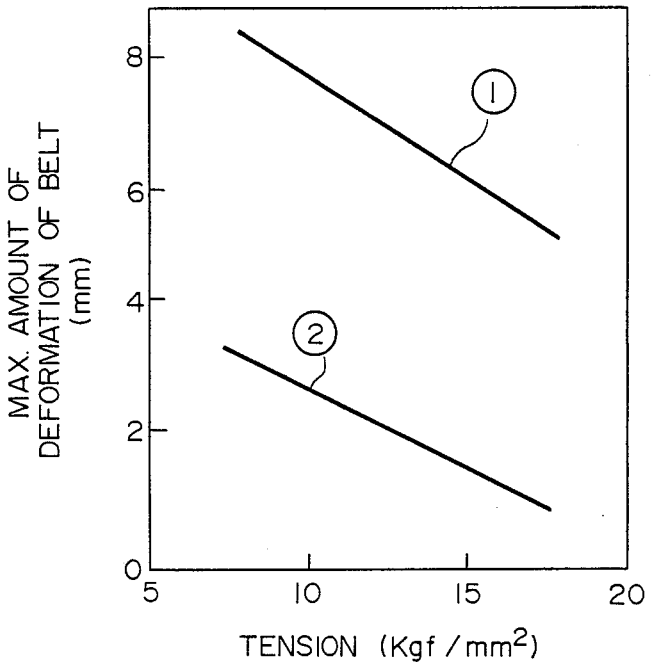
FIG. 22 is a graph illustrating the effect of the embodiment shown in FIG. 21.

Under the above-described conditions, a steel casting test was performed by using the tension of the belt as a variable, the displacement of the belt was measured in the same way as described above, and the amount of occurrence of internal cracks in castings was investigated. The results of measurement of the maximum amount of displacement of the belt are shown in FIG. 22.

In this graph, line ① shows the case where heating by the preheater was not performed, while line ② the case where the preheater was used. When the belt preheated to 120°-140° C. by using the preheater and the belt tension was set to 8 kg/mm$^2$ or more, it was possible to restrain the maximum amount of displacement of the belt to 3 mm or less. By taking the above-described procedure, it was also possible to retrain the length of internal cracks of the castings to a low level.

In the above, although an example has been illustrated in which an edge heater and a preheater are used, both the edge heater and the preheater are not required in cases where the belt width is 1,500 mm or less and the casting width is 200 mm narrower than the belt width, i.e., under the condition where 100 mm-wide edge dams are respectively present at the side edge portions of the belt.

Figure 23:
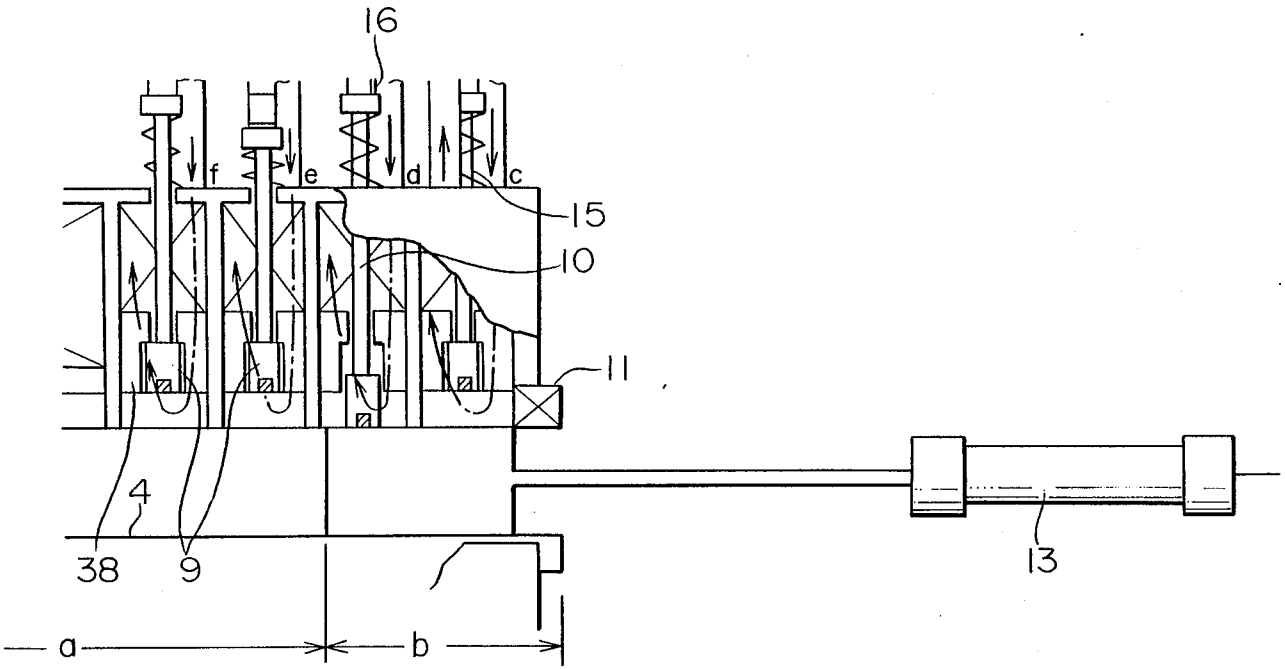
FIG. 23 is a diagram illustrating an embodiment in which the device for heating the side end portions of the belts is not used.

FIG. 23 illustrates an arrangement of an end portion of the mold in this example. The casting width is 1,500 mm, and, the condition is that the cooling water is allowed to flow through the cooling/heating chamber adjacent to the casting mold. At this time, as for the displacement of the belt, in the case of the casting width of 1,300 mm, the amount of belt displacement was as same as that indicated by line ② of FIG. 15, the amount of belt displacement was 2.6 mm, and was of a level which was allowable in terms of the quality of the castings.

A description of the restricting conditions in heating the edge dam will be given hereafter in accordance with a fifth embodiment.

A steel product was cast by using a twin belt type continuous casting machine. The width of the belt used for the belt mold was 1,900 mm, and the thickness was 1.2 mm. Respective 100 mm-wide side end portions of the belt were heated to 100°-120° C. by electromagnetic induction heaters; respective 30 mm portions continuing therefrom were held in contact with the sealant; further 50 mm-portions of the belt disposed inwardly thereof were respectively heated by superheated steam at 120° C.; and still further 90 mm-portions of the belt disposed inwardly thereof were respectively made to abut against the copper-made edge dams. The belt tension was set to 15 kgf/mm$^2$, and the width of the metal produced was 1,360 mm, and the thickness thereof, 50 mm.

On the other hand, the amount of water for the edge dam cooling device was varied to different levels, and the surface temperature of the edge dam immediately upstream of the casting portion was measured in advance by a contact thermometer so that the temperature of the edge dam can be estimated from the operating conditions.

Figure 24:
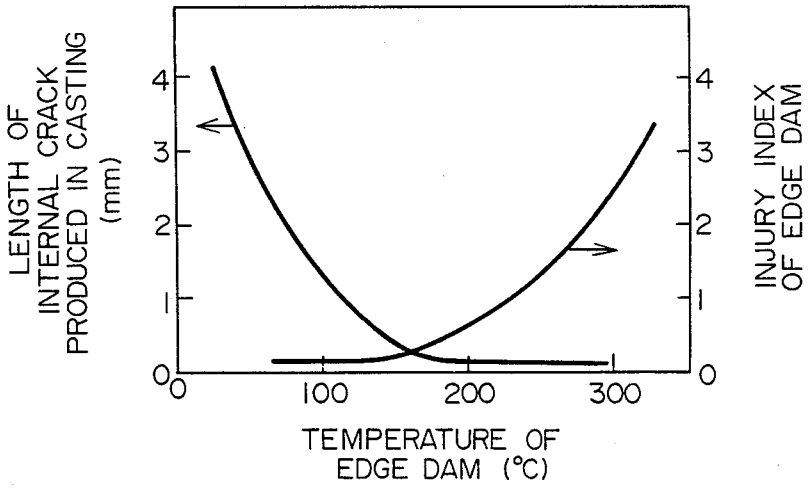
FIG. 24 is a graph illustrating the effect of increasing the temperature of the edge dam supporting blocks on the length of internal cracks formed in castings.

After the above preparations were made, casting was performed under various cooling conditions of the edge dam, and an investigation was made on the relationship between the cooling conditions and the quality of the castings. The results are shown in FIG. 24.

From these results, it was found that, to set the length of the internal cracks of the castings to 1.5 mm or less, it is necessary to set the temperature of the edge dam to 100° C. or above. It was also found that, if the temperature of the edge dam is less than 100° C., the belt is cooled by the edge dam, and belt displacement occurs in the belt, resulting in the poor quality of the castings, and that, if the temperature of the edge dam exceeds 150° C., the damage to the edge dam becomes larger. Accordingly, it was found that an appropriate temperature range of the edge dam is 100°-150° C.

Description will be given of a sixth embodiment of the present invention, in which molten steel is cast by using width-variable edge dams, and the width of the metal being cast is altered in the course of casting.

In the twin type continuous casting machine, the following arrangement was provided: A mold was used in which an upper cooling structure was made into the jet cooling structure 6*a*, while a lower cooling structure was made into the pad cooling structure 6*b*. These two structures are arranged such that the width of the cooled portion and the heated portion of the belt were respectively made variable by following the casting width of the molten metal. In addition, a gas heating device 60 was installed immediately upstream of the upper roll so that the belt can be heated to 150°-170° C. over the entire width of the belt. Furthermore, as for the edge dams which are adapted to move in synchronism with the belt, the temperature of the edge dams was adjusted in a return process by controlling the amount of cooling water for the edges of the edge dams in such a manner that the temperature becomes 120°-150° C.

Molten steel was cast by using this casting machine. As for the cross-sectional size of the castings thus produced, casting was effected with a width of 2,060 mm and a thickness of 50 mm during the first 30 minutes and with a width of 1,660 mm and a thickness of 50 mm during the last 30 minutes.

The test conditions were as follows; during the production of 2,060 mm-wide castings, 100 mm-portions from the side ends of the belt were respectively set as the range for electromagnetic induction heating; respective 30 mm-portions continuing therefrom were held in contact with the sealant; and further 90 mm-portions were held in contact with the copper-made synchronously moving edge dams. During the production of 1,660 mm-wide castings, 100 mm-portions from the side ends of the belt were respectively set as the range for electromagnetic induction heating; continuing 30 mm-portions were respectively held in contact with the sealant; further 200 mm-portions were set as the range which was subjected to heating with steam supplied to the heating/cooling chamber; and still further 90 mm-portions were respectively held in contact with the synchronously moving edge dams. The overall width of the belt was 2,500 mm.

The test results are shown in Table 1. Thus, despite the fact the casting width was varied in the midst of casting, it was possible to obtain castings of excellent quality in both cases of the casting widths of 2,060 mm and 1,660 mm by virtue of the various operating conditions including the preheater, edge heaters, heating of the rear surface of the belt with steam, the temperature control of the edge dams to high temperature, and application of high tension to the belt.

These results coincided with those obtained earlier in the preliminary experiment on the deformation of the belt, i.e., that, although, in the case of the 2,500 mm-belt width, the amount of belt deformation was large at 5-6 mm in the range of the casting width of 1,660-2,060 mm through only the heating of the side end portions of the belt, which is insufficient for restraining the belt deformation, yet the amount of belt deformation can be reduced to a desirable range by performing preheating.

TABLE 1

| Test No. | Casting width (mm) | Preheater | Edge heater/ heating with steam/Control of edge dams at high temp. | Quality of castings |
|---|---|---|---|---|
| 1 | 2060 | on | on | ◎ |
| 2 | 2060 | off | on | X |
| 3 | 2060 | on | off | X |
| 4 | 1660 | on | on | ◎ |
| 5 | 1660 | off | on | X |
| 6 | 1600 | on | off | X |

◎excellent
X bad

WHAT IS CLAIMED IS;

1. A twin belt type continuous casting machine having a pair of belts and a pair of edge dams disposed between said pair of belts to define a metal pool so as to produce a thin slab by allowing a molten metal poured into said metal pool to be cooled and solidified, said edge dams being disposed between said belts in such a manner as to be movable in the transverse direction of said belts, said twin belt type continuous casting machine comprising:

a plurality of cooling/heating chambers disposed respectively such as to be adjacent to respective rear surfaces of said pair of belts and to be in the vicinity of side end surfaces of said belts in a transverse direction of said belts and partitioned in said transverse direction;

a cooling box disposed in the vicinity of a central portion in said transverse direction of said belts;

a plurality of pressing means which are capable of pressing said rear surfaces of said belts;

a fluid supplying piston header in which one portion of an internal space thereof divided into two by a piston, is connected to a cooling water supplying source, and the other portion thereof is connected to a heating medium supplying source for heating side end surfaces of said belts, a plurality of branch channels respectively communicating with said plurality of cooling/heating chambers in the axial direction being provided in said internal space;

a discharge piston header provided with a plurality of discharge-side branch channels respectively communicating with said plurality of cooling/heating chambers; and a control device for selectively actuating at least one of said plurality of pressing means in such a manner as to press said belts against said edge dams moved.

2. A twin belt type continuous casting machine according to claim 1, further comprising:

a controller for moving said edge dams and said piston in synchronism with each other and for synchronously actuating said pressing means relative to said edge dams moved.

3. A twin belt type continuous casting machine according to claim 1, wherein said plurality of pressing means includes edge dam supporting blocks respectively disposed in said plurality of cooling/heating chambers and are adapted to actuate a desired one of said edge dam supporting blocks.

4. A twin belt type continuous casting machine according to claim 1, wherein said plurality of cooling-/heating chambers are arranged in a plurality of stages in a casting direction.

5. A twin belt type continuous casting machine according to claim 1, wherein said plurality of pressing means is constituted by a plurality of throttling devices provided at respective fluid outlets of said plurality of cooling and heating chambers, and each of said belts is adapted to be brought into pressure contact with said edge dams as at least one of said throttling devices is selectively actuated and the static pressure of said cooling/heating chamber at a position corresponding to said edge dam moved.

6. A twin belt type continuous casting machine according to claim 1, further comprising a pair of synchronously moving edge dams moving in synchronism with the metal being cast as well as a cooling mechanism and a control mechanism for controlling the temperatures of said synchronously moving edge dams to a range from 100 to 150 C.

7. A twin belt type continuous casting machine having a pair of belts and a pair of edge dams disposed between said pair of belts to define a metal pool so as to produce a thin slab by allowing a molten metal poured into said metal pool to be cooled and solidified, said edge dams being disposed between said pair of belts in such a manner as to be movable in the transverse direction of said belts, said twin belt type continuous casting machine comprising:

a group of disk rolls provided on the rear surfaces of said belts to maintain the flatness of said belts;

a plurality of cooling/heating medium distributors disposed in said transverse direction of said belts and to allow cooling and heating in a divided manner in said transverse direction of said belts;

a fluid supplying piston header in which one portion of an internal space thereof divided into two by a piston is connected to a cooling water supplying source, and the other portion thereof is connected to a heating medium supplying source for heating side end surfaces of said belts, a plurality of branch channels respectively communicating with said plurality of cooling/heating medium distributors in the axial direction being provided in said internal space; and a controller for causing said group of disk rolls to be expanded or shrunk by following said edge dams moved, whereby said group of disk rolls are adapted to be capable of being automatically expanded or shrunk in said transverse direction of said belts by following the movement of said edge dams moved.

8. A twin belt type continuous casting machine according to claim 7, further comprising a pair of synchronously moving edge dams moving in synchronism with the metal being cast as well as a cooling mechanism and a control mechanism for controlling the temperatures of said synchronously moving edge dams to a range from 100° to 150° C.

* * * * *